US005188876A

United States Patent [19]

Hensel et al.

[11] Patent Number: 5,188,876

[45] Date of Patent: * Feb. 23, 1993

[54] SURFACE COVERING WITH INORGANIC WEAR LAYER

[75] Inventors: Robert D. Hensel, Millersville; Leonard N. Ray, Jr., Lancaster; Joseph F. Reuwer, Jr., Lancaster; Jeffrey S. Ross, Lancaster; Jerome D. Wisnosky, Lancaster, all of Pa.

[73] Assignee: Armstrong World Industries, Inc., Lancaster, Pa.

[ * ] Notice: The portion of the term of this patent subsequent to Dec. 31, 2008 has been disclaimed.

[21] Appl. No.: 679,306

[22] Filed: Apr. 2, 1991

Related U.S. Application Data

[63] Continuation-in-part of Ser. No. 507,875, Apr. 12, 1990, Pat. No. 5,077,112.

[51] Int. Cl.[5] ..... B32B 3/00

[52] U.S. Cl. ..... 428/76; 428/908.8; 428/698

[58] Field of Search ..... 428/76, 908.8, 698

[56] References Cited

U.S. PATENT DOCUMENTS

| | | | |
|---|---|---|---|
| 3,984,581 | 10/1976 | Dobler et al. | 427/35 |
| 4,764,496 | 8/1988 | Narui et al. | 428/698 |
| 4,770,923 | 9/1988 | Wasa et al. | 428/212 |

FOREIGN PATENT DOCUMENTS

| | | |
|---|---|---|
| 1206771 | 9/1970 | United Kingdom . |
| 1206908 | 9/1970 | United Kingdom . |
| 1251723 | 10/1971 | United Kingdom . |
| 1335065 | 10/1973 | United Kingdom . |
| 2202237 | 9/1988 | United Kingdom . |

OTHER PUBLICATIONS

J. Fournier et al., "Preparation and Characterization of Thin Films of Alumina by Metal-Organic Chemical Vapor Deposition", 1988, *Materials Research Bulletin*, vol. 23, pp. 31-36.

*Primary Examiner*—Patrick J. Ryan
*Assistant Examiner*—Cathy K. Lee

[57] ABSTRACT

A surface covering is a laminate including a hard inorganic wear layer deposited on a support by a reduced pressure environment technique such as ion assisted physical vapor deposition. The support may be selected from metal foils, films or sheets and plastics, rubbers or mineral/binder systems. The preferred support materials include organic materials. The wear layer is between 1 micron and 25 microns in thickness and has a CIE LAB value of total Delta E of less than 12. Preferably, the wear layer is deposited on the support at a temperature of less than 175° C.

17 Claims, 2 Drawing Sheets

SURFACE COVERING WITH INORGANIC WEAR LAYER

CROSS REFERENCE TO RELATED APPLICATION

This application is a continuation-in-part of U.S. Application Ser. No. 507,875 filed Apr. 12, 1990, in the names of Robert Hensel et al. and entitled "Floor Covering With Inorganic Wear Layer", now U.S. Pat. No. 5,077,112, issued Dec. 31, 1991.

BACKGROUND OF THE INVENTION

The invention relates to a surface covering. More particularly, the invention relates to a surface covering having an inorganic wear layer which preferably has been deposited on a support structure by a low pressure environment deposition technique.

Floor coverings having wear layers are well known in the art. Such wear layers protect the decorative layer of the floor coverings and lengthen the useful life of the floor covering. With the exception of ceramic tile which are rigid and must typically be installed on a mortar bed and metal floors such as steel plates, neither of which have a wear layer per se, inorganic material is not used as the wear surface of floor coverings. Inorganic materials are typically considered too brittle to be walked on; particularly if a "thin" layer were to be placed over a flexible or conformable support layer. Further, low pressure environment deposition techniques have not been applied to the manufacture of floor coverings.

Reduced pressure environment techniques for depositing films of hard inorganic materials include sputtering, plasma polymerization, physical vapor deposition, chemical vapor deposition, ion plating and ion implantation. Hard inorganic materials which can be prepared using these techniques include metals, metal oxides, metal nitrides and mixtures thereof; such as aluminum oxide, silicon oxide, tin and/or indium oxide, titanium dioxide, zirconium dioxide, tantalum oxide, chromium oxide, aluminum nitride, boron nitride, silicon nitride, titanium nitride, and zirconium nitride.

Often the partial pressures of key gases in the deposition environment are controlled to effect the properties and compositions of the deposited material. Therefore, a film formed on a substrate by reactive sputtering or reactive deposition can be a compound derived from a metal and a controlling gas, i.e., aluminum oxide produced by sputtering aluminum in oxygen. Sometimes the controlling gases are used to sustain a plasma in the deposition environment. Ion assisted deposition is a technique in which the controlled gas is ionized and is used to bombard the deposition surface to modify the morphology and physical properties of the resulting film.

A critical review of vapor deposition technology related to hard coatings was presented by J. E. Sundgren and H. T. C. Hentzell in *J. Vac. Sci. Tech. A*4(5), September/October 1987, 2259–2279. A more complete review of techniques involved in formation of thin films in reduced pressure environments is the book edited by J. L. Vossen and W. Kern, *Thin Film Processes,* Academic, New York, 1978.

Recent articles on thin film preparation include Clevenger, L. A., Thompson, C. V. and Cammarata, R. C., *Appl. Phys. Letter,* 52(10), 7 March 1988, 795–797 on using commercial photoresists as supports; and *Journal of Materials Science Letters,* (1986), 177–178.

Patents dealing with thin film deposition include: U.S. Pat. Nos. 4,604,181 and 4,702,963.

Reduced pressure environment techniques have been used to coat plastics materials such as plastic bags to improve gas impermeability. However, such coatings have been limited to about 0.5 microns in thickness.

While reduced pressure environment techniques have been used to form hard coatings on surfaces such as automobile parts, there has been no suggestion that such coatings could be successfully used as wear surfaces for floor coverings. In fact, such coatings tend to be brittle when applied in a substantial thickness. Thus, one skilled in the flooring art would not expect reduced pressure environment deposited materials to function adequately as a floor covering or on other support surfaces which are flexible, particularly in the thickness deemed necessary to protect the decorative layer of a floor covering.

Alliance Wall manufactures and sells wall coverings in which porcelain enamel is fused to a steel sheet. However, use of a material as a wall covering does not suggest that it would be acceptable as a floor covering. Again, one skilled in the flooring art would not expect a thin sheet of ceramic to withstand the long term abuse to which flooring is subjected, particularly when laid over a resilient support structure and walked on by a woman in high heels.

Further, while reduced pressure environment techniques have been used to prepare protective coatings on plastics, the thickness of the prior art protective coatings generally do not exceed 0.5 microns. Typically this is because the deposition of hard coatings at greater thicknesses causes the temperature to exceed the allowable use temperature of the support. In addition, it is widely believed that although a hard inorganic coating on a polymer would provide some protection function, the brittleness associated with hard materials usually is believed to be a severe limitation. In fact, we have found that the brittleness is not a limitation, and have prepared materials that function superbly as protective coatings on organic layers or substrates.

SUMMARY OF THE INVENTION

An object of the invention is to provide a surface covering including a support and a wear layer deposited on the support by a reduced pressure environment technique. The wear layer is a 1 micron to 25 microns thick hard inorganic material.

Such a covering has been made by depositing a wear layer of a hard inorganic material on a support by a reduced pressure environment technique. The preferred reduced pressure environment technique is ion assisted physical vapor deposition; and the preferred support is multilayered.

Hard inorganic materials include aluminum oxide, tungsten, steel, silicon oxide, zirconium oxide and titanium oxide. Soft inorganic materials include aluminum, gold and copper. The hard inorganic materials from which the thin films of the present invention are formed have a Mohs hardness in their bulk form of at least 5 Mohs, preferably at least 7 Mohs and most preferably at least 9 Mohs.

The preferred hard inorganic material is a metal oxide or metal nitride; most preferably aluminum oxide, nitrides and oxynitrides of aluminum and silicon. Also preferable are oxides, nitrides, and oxynitride materials that contain mixtures of silicon and aluminum. The mixtures may be homogeneous or layered, and may also contain additional elements for the purpose of making processing simpler or less costly, or to enhance the appearance of the final layer. Aluminum oxide and silicon nitride form films which are colorless, clear and of hardness similar to the dirt to which the surface covering is normally subjected. The oxides and nitrides of the present thin films are not necessarily stoichiometric but are believed to be close to stoichiometric.

In one preferred embodiment the supports include a metal component such as a foil, a film or a sheet. The metal support may be from 0.001" to 0.25" thick, preferably 0.003" to 0.1" thick. The preferred support is a stainless steel sheet of at least 0.007 inches in thickness. Although a low carbon steel may be used its performance is poorer. Preferably, the support includes a decorative layer of fused glass or ceramic frit overlying the metal component.

Since the glass or ceramic is a metal oxide which can be deposited by a reduced pressure environment technique, the wear layer can be formed from a glass or ceramic material. That is, the decorative layer can be the wear layer.

Depositing a hard inorganic material on surface of a plastic, rubber or mineral/binder system support substrate improves the wear resistance and falls within the scope of the present invention. The plastic may be either a thermoset or thermoplastic. The preferred thermoplastic is polyethylene terephthalate. The preferred thermoset plastic is a crosslinked reinforced polyester such as polyester sheet molding compound sold by Premix, Inc. The thickness of the support should be between 0.0005" and 0.25".

An additional preferred support is a colorless transparent polymer film. The film may be either thermoplastic or thermoset. The film may contain a back-printed image, or it may be pigmented for a decorative purpose. An additional preferred support would include the above film that has been laminated to another composite layered structure that may contain a visual image for which the wear layer on the film would provide enhance appearance retention.

Reduced pressure environment techniques are used on a large scale for preparation of thin film aluminum coatings on plastic webs. These are used for decorative purposes, as microwave susceptors in food packaging, as antistatic coatings in electronics packaging, and as vapor barriers. On a lesser scale, reduced pressure environment techniques are used to prepare other inorganic thin films on polymer substrates for applications such as electroluminescent screens, security systems, vapor barriers, antistatic coatings, and as protective layers.

However, in most applications, the thickness of the inorganic layer is limited to less than one micron. Specific applications in which reduced pressure environment techniques have been used to deposit thicker layers include the application of protective zirconia layers to aircraft engine parts; the application of early transition metal nitride films to metal substrates for decorative purposes; and the application of metal nitride and carbide coatings to tool steel to extend usable life. For these "thick" applications, the process temperature of the reduced pressure technique exceeds the use temperature of most plastics. In addition, each of the support systems is a rigid material that has the characteristic of good impact, scratch, abrasion, or fracture resistance, or a high yield strength.

It is generally accepted that resilient, soft materials such as most plastics would not be capable of providing support for a thin hard inorganic layer. The usual argument is that any amount of flex in the inorganic layer would be sufficient to allow the inorganic layer to fracture. Furthermore, it is generally accepted that the fracturing would ruin the protective function of the film.

An aspect of this invention is that formation of a layered composite structure containing an inorganic protective layer is possible. Furthermore, even though the protective layer may contain cracks or fractures, it still functions adequately as a protective layer. In addition, if during its lifetime, the protective layer becomes fractured, its function as a protective layer continues, albeit at a slightly lower level specifically regarding transmission of gases and fluids. However, overall the performance of the protective layer exceeds that of other currently known protective layers such as organics and organic/inorganic composites, and it exceeds the performance of thin (less than one micron) layers of the same material.

Another property of this invention is the adhesion between the inorganic layer and the polymer film. It is generally accepted in the coating industry that application of an inorganic layer, especially a nitride, oxide, or oxynitride, especially either evaporative or sputtering techniques, will result in formation of an inorganic layer that has an intrinsic stress. It is also generally accepted that as the thickness of a deposited film exceeds 0.5 micron, the stress builds to such a high level that spalling or flaking of the coating occurs. Thus, this invention demonstrates that a well adhered coating of a metal oxide can be prepared at a thickness between 1 micron and 25 microns and still remain adhered to a plastic substrate. The general structure that has been invented is a thick (preferably 1.0 to 25 microns, more preferably 2 microns to 25 microns, and most preferably 3 microns to 15 microns), well-adhered, inorganic oxide, nitride or oxynitride, on a polymer support.

The specific application we have demonstrated good performance in is the use of this material as a floor covering. It could generally be used as any surface covering. Examples would be as counter or desk tops, windows, automotive parts, textile protection. The material could be used as an abrasive like sandpaper, or it could be formed into a tread for use as a woven material or for use as an abrasive string (like a weed wacker). The fabrics made from the material could be used in flame retardant applications or for use in other safety related applications like protective aprons, covers or gloves.

DETAILED DESCRIPTION OF THE INVENTION

Figure 1:
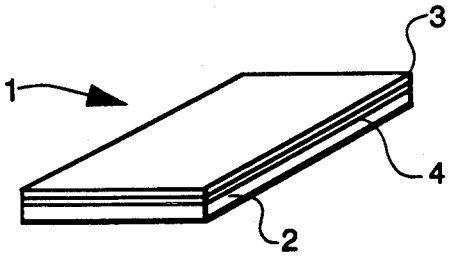
FIG. 1 is a perspective view of a first embodiment of the present invention.

Broadly, the invention is a surface covering having a hard inorganic material wear layer and a support including metal or plastic. While the preferred floor covering is a flexible laminate which has been deposited on a support by a reduced pressure environment technique and which permits installation similar to conventional resilient flooring, including resilient tiles; the invention is intended to include rigid floor coverings having a wear layer of reduced pressure environment deposited hard inorganic material, and conformable floor coverings having a glass or ceramic material applied to a metal support by means other than a reduced pressure environment technique.

The invention also includes surface coverings, in general, which have a thick, hard inorganic wear layer deposited on a support by a reduced pressure environment technique. Preferably the wear layer is 1 micron to 25 microns in thickness, preferably at least 2 microns thick, and most preferably 3 microns to 15 microns thick.

In one preferred embodiment, the substrate is a thermoplastic such as a polyester thermoplastic polyurethane, thermoplastic polyacrylate, polycarbonate or polyvinyl, or a thermoset, such as a crosslinked polyester, thermoset polyurethane, thermoset polyacrylate, polyether or epoxy, which have relatively low melting points or temperatures at which the substrate material is destroyed or degraded. Therefore, it is preferred that the wear layer be deposited at a temperature of no greater than 175° C., more preferably no greater than 150° C., and most preferably no greater than 100° C.

At these temperatures, those skilled in the art believe the properties of the deposited layer have been degraded to an unacceptable level. However, it has been found that the deposited layer retains sufficient properties to function as a wear layer and even at the thickness of greater than 1 micron the preferred layers remain substantially transparent and colorless.

Color is measured by CIE LAB tests. In the preferred embodiment total Delta E is less than 12, more preferably less than 6, and most preferably less than 3.

Metals and hard inorganic materials such as ceramics have unique properties. Properly selected ceramics are hard enough to resist being scratched by the grit particles in dirt. Properly selected metals should be hard enough to support the ceramic and yet be flexible. Such a laminate can be made in an atomistic deposition chamber by depositing on a thin, properly tempered steel. This laminate could then be mounted on an organic-polymer support layer to form a flooring structure. The support layer conforms to the subfloor irregularities and accommodates lateral movement of the subflooring structure. Although vacuum techniques could be used in making such a flooring structure, current technology would enable it to be made on a continuous, air-to-air production line.

No organic surface, either currently in existence or envisioned, possesses sufficient resistance to loss of gloss and to other physical damage to fully meet desired performance. Thick (¼ inch), hard ceramic tiles (Mohs hardness of at least 7 and preferably 8.5) resist loss of gloss and other physical damage extremely well.

The Mohs hardness of grit particles in dirt probably ranges between 6 (silicates) and 7 (silica). A rule of thumb among tribologists is that if a surface is 1.5 Mohs units harder than a grit particle, the surface will not be scratched by the grit particle. This applies when the grit particle is between two surfaces of equal hardness. In a flooring situation, the grit particle is usually between the relatively soft bottom surface of a shoe and the floor surface. Therefore, the maximum downward force on the grit particle is the resistance the bottom of the shoe offers to penetration by the grit particle. The softer the bottom of the shoe, the less downward force exerted on the particle. Consequently, the difference in hardness between the grit particle and the flooring surface may not need to be quite as large as 1.5 Mohs units. In any case, a Mohs hardness of 8.5 is a reasonable goal for the ceramic film. However, wear layer of Mohs hardness of about 5 or 7 have been shown to retain gloss level despite larger scratches. Prior art organic wear layers have a Mohs hardness of less than 3. Therefore a Mohs hardness of 3 or greater will yield an improvement.

If formed by atomistic deposition, the ceramic-film wearlayer envisioned for the laminate structure would be expected to be essentially stain proof and to retain its gloss extremely well. The film would be expected to be essentially stain proof because such films provide excellent corrosion resistance for the substrates on which they are deposited. The film retains its gloss and resists damage from grit particles because it can be made sufficiently hard, approaching the hardness of the grit particles in dirt, and may be supported on a support having proper stiffness.

Although ceramic film has both stain resistance and gloss retention, its brittleness has prevented it from being used as a wear layer in a resilient floor covering. Brittleness makes the ceramic film susceptible to serious damage. However, by combining the ceramic film with a support such as a sheet of metal or plastic with the proper characteristics, a ceramic film may be used. If the support is sufficiently strong to give the floor covering the ability to support a uniform 125 lbs/sq ft load with a deflection of not more than one-five hundredths of the span, the floor covering may be free standing. Ceramic tile does not have this ability. Laminate must have the necessary physical properties as discussed below.

In order to understand why such a laminate should solve the problem of brittle damage, it is useful to divide the types of forces causing damage into two categories: (1) localized pressure and (2) impact.

Localized pressure occurs when a grit particle is pressed downward against the ceramic surface. If the particle can force the ceramic film down into the support layer on which it has been deposited, the ceramic film is put into tension and fails. Ceramics, although strong in compression, are weak in tension. To avoid such failure in tension, the support layer must resist being indented when the grit particle is pressed against the ceramic film. Actually, all the ceramic film does in protecting the support layer from indentation is to spread the force over a greater area before that force reaches the support layer. Hardened steel appears to combine the desired hardness (up to a Mohs of almost 7) and flexibility. Although lacking the hardness of steel, some organic polymers, particularly engineering polyesters, have provided adequate support.

A ceramic/metallic laminate also possess the properties needed to resist impact. Impact occurs when a heavy object strikes the floor. Damage is most likely to occur when the pressure (that is force per unit area) is large enough to cause an indentation. Here the tensile strength of the steel should resist putting the ceramic in tension.

An additional property that the support layer should possess is the ability to produce a gradual contour rather than an abrupt contour, both when a grit particle exerts a force on it through the ceramic film and when it is subjected to impact. Calculations have shown that for a given vertical displacement, a gradual contour subjects the ceramic film to less tension than does the abrupt contour. In order to produce a gradual contour, the support layer should be flexible but not limp. Two materials that possess the desired properties are properly tempered spring steel and polyester based sheet molding compounds.

The ceramic film should have hardness at least of about 6 Mohs and good strength. To possess these attributes, the ceramic must have the proper microstructure. In films formed by atomistic deposition, desirable microstructure can be attained by increasing the temperature and the bombardment energy. One of the advantages of using a steel support layer is that a high enough temperature can be used to get optimum microstructure.

The ceramic film should be applied so that it is under compression. This can be accomplished by depositing the metal-atom portion of the ceramic first and then adding the other element later, either in the same step or in a second step. Using a two-step process allows better control for deposition of the nonmetallic atoms.

The ceramic/metallic laminate is preferably adhered to a conformable support layer. This support layer must be hard enough to support the ceramic/metallic laminate but must also be able to conform to any irregularities in the subfloor. To perform in a superior manner, the conformable support layer should be capable of inelastic deflection, i.e., capable of permanent deflection with or without residual forces such as applied by adhesives.

In addition, if used in resilient sheet goods it must accommodate some lateral movement of the subfloor. To be able to perform over all subfloors including particleboard, the floor covering should have a rupture strain in excess of 0.3%. Due to seasonal changes including temperature and humidity, particleboard subfloors expand and contract about 0.3% during the year. Plywood expands and contracts about 0.15%. Therefore, to perform adequately over a wooden subfloor, the floor covering including the wear layer should have a critical buckle strain of at least 0.1% and preferably at least 0.3%. Floor coverings of the present invention having plastic support structures meet this requirement.

The support layer preferably is typically made from an organic polymer. It is desirable to select the polymer so that its viscoelastic character will allow it to conform to the floor and still enable it to resist indentation by a rapid impact.

Surface contours can readily be incorporated by embossing the metallic substrate layer before application of the ceramic film. Incorporation of a pattern could be done most readily by printing the pattern on the metallic substrate before deposition of the ceramic film. Some of the ceramic films that can be deposited atomistically are colored, and they may be applied in patterns by use of stencils.

Although the focus of this invention is on atomistically deposited ceramics, the concept of a thin flexible metallic substrate layer could be used with other types of ceramics. Colored ceramic glazes or inks used in conventional ceramic technology could be applied in a pattern on the metallic substrate layer to form a wear-layer in place of the atomistically deposited ceramic film.

The basic concept is combining thin, hard wear surfaces with decorative, support structures to produce unique wear-resistant flexible flooring products. The flooring products have the appearance retention appoximating that of ceramic tile but are light weight and easier to install.

A series of inorganic oxides and nitrides (including aluminum oxide and) has been used as the thin, hard inorganic wear layer. The variety of materials used for the support layers include combinations of metals, plastics, rubber and mineral/binder systems. The means of decoration include glass frits, holograms, sublimable dyes and pigmented inks. The plastics, rubber and mineral/binder systems may be through color. Outstanding performance has been demonstrated in an embodiment consisting of three microns aluminum oxide over ten microns glass decorative layer on seven mils tempered steel shim stock bonded either to a filled vinyl tile or a layer of rubber and in sublimable ink decorated polyester sheet molding compound (PSMC). Aluminum oxide coated PSMC resists scratches better than any organic or organic/inorganic coating tested.

Since each layer of the floor covering laminate affects performance, a layer of rotogravure ink will change the appearance retention of a wear layer on a plastic support. Therefore, inks, such as sublimable inks, which will diffuse into the support layer are preferred.

The advantages of the flooring products of the present invention include an appearance retention in traffic environments in a product which can be light in weight, which can be either rigid or conformable, which can be thinner than products currently in the market place, which can be flexible, which can be more resilient than ceramic tile, and which can be installed with conventional resilient-flooring tools.

One preferred embodiment of the floor covering 1 is shown in FIG. 1. The support 2 is a metal, plastic, rubber or mineral/binder system. A wear layer 3 of hard inorganic material is deposited on the support by a reduced pressure environment technique. A decorative layer 4 is deposed between the support layer and the wear layer. The preferred metal is stainless steel. While such metals as ferroplate, brass/ferroplate, steel/ferroplate, chromium-plated brass and 01 steel have been used, any flexible but stiff support can be used.

The preferred thickness of the support is from about three to about nine mil, most preferably about five to about seven mil. Two and four micron alumina wear layers on three, five and seven mil tempered shim steel did not crack even when the resulting laminate was supported by a deformable rubber of Shore hardness 70 and walked on by women in high heels. The three-mil substrate could be pierced by high heels.

The preferred modulus is about $3\times10^7$ lbs./inch$^2$. A modulus of this value or less ensures that the laminate is sufficiently flexible to bend around a 2-inch mandrel without the wear layer cracking, even when the wear layer is on the convex side. Preferably, the floor covering is sufficiently flexible to bend around a 20-inch mandrel without cracking.

The support substrate may also be a decorated or undecorated plastic, rubber or mineral/binder system provided the support layer is sufficiently rigid. The support layers tested include a polyester sheet molding compound (PSMC), rigid polyvinylchloride (PVC) on a tile base, polyethersulfone on a glass base, glass fiber reinforced polyester, fiber filled phenolic, polyetheretherketone with and without a glass base, polyimide on a glass base, polymethylmethacrylate, a photographic polyester on a glass base, Teflon, and PVC on PSMC. A preferred polyester support substrate material is PSMC or polyethylene terephthalate. A fiber filled polyester is more stable and yields fewer cracks.

The thickness of the wear layer must be at least one micron. Preferably the thickness of the wear layer is at least about three microns. Thickness of less than three microns tend to fail more frequently.

Hardness of the wear layer equal to and preferably greater than that of silica also is desirable. Preferably the hardness is at least 6 Mohs, and more preferably 8.5 Mohs.

The invention includes wear layers of metal, metal oxides and metal nitrides. The preferred compositions include $Al_2O_3$, AlN and $Si_3N_4$. Flooring structures with five to eight microns of $Al_2O_3$ supported on an undercoated, reinforced polyester substrate had gloss retention superior to currently marketed wear layer materials. Although individually visible scratches were apparent, the scratches did not affect gloss retention. The scratches can be eliminated or at least minimized by obtaining a good match between the mechanical properties of the substrate and the wear layer. Gloss retention and overall appearance retention is increased by increasing wear layer hardness and substrate hardness. Therefore, $Si_3N_4$ may be a superior wear layer to $Al_2O_3$.

The decorative layer 4 is a glass or ceramic frit, or pigment. The use of printable inks enables the creation of intricate designs. However, since the wear layer materials may be colored, the wear layer and decorative layer may be combined and a multi-colored wear layer can be deposited with a low pressure environment technique with the use of stencils.

The structure of the FIG. 1 embodiment is acceptable for a resilient flooring structure which is rolled for storage and transport to the installation site, provided the laminate is sufficiently flexible. However, if the flooring structure is a 12×12 inch tile having a rigid support structure, the tile may not be capable of conforming to the irregularities of a wood subfloor and therefore may require installation procedures similar to ceramic or marble.

Figure 2:
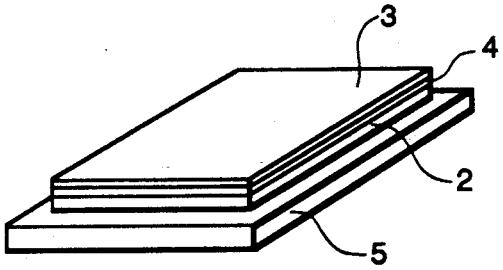
FIG. 2 is a perspective view of a second embodiment of the present invention.

To overcome this disadvantage the laminate may be bonded to a resilient or conformable layer 5 as shown in FIG. 2. The conformable layer 5 has dimensions slightly greater than the laminate. This allows for the difference in thermal expansion between the subfloor and the laminate. The conformable layer is capable of inelastic deflection under gravitational forces so that over a reasonable length of time, the lower surface of the laminate contacts the subfloor over substantially the entire surface area. The conformable layer is capable of conforming to the contour of the subfloor, including a 1/16" ledge between two plywood sheets forming the subfloor.

Figure 3:
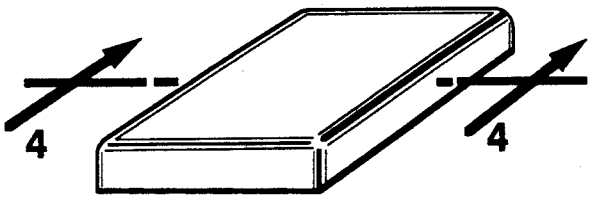
FIG. 3 is a perspective view of a third embodiment of the present invention.
Figure 4:
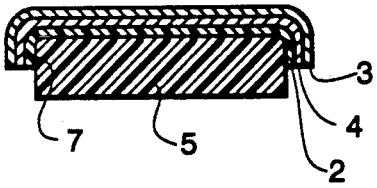
FIG. 4 is a cross-sectional view taken along line 4–4 in FIG. 3.

The sharp corners of the FIG. 2 embodiment may cause problems since the tiles cannot be laid in a perfectly flat plane. Therefore, the corners tend to snag the soles of shoes. To avoid this problem, the tile may be formed as shown in FIGS. 3 and 4. The laminate of support structure 2, decorative layer 4 and wear layer 3 is formed. Then the laminate is press molded into a cup-shape and bonded to the resilient support base 6. The sides 7 of the laminate are substantially perpendicular to the plane of the conformable layer and are adjacent the sides of the conformable layer.

Figure 5:
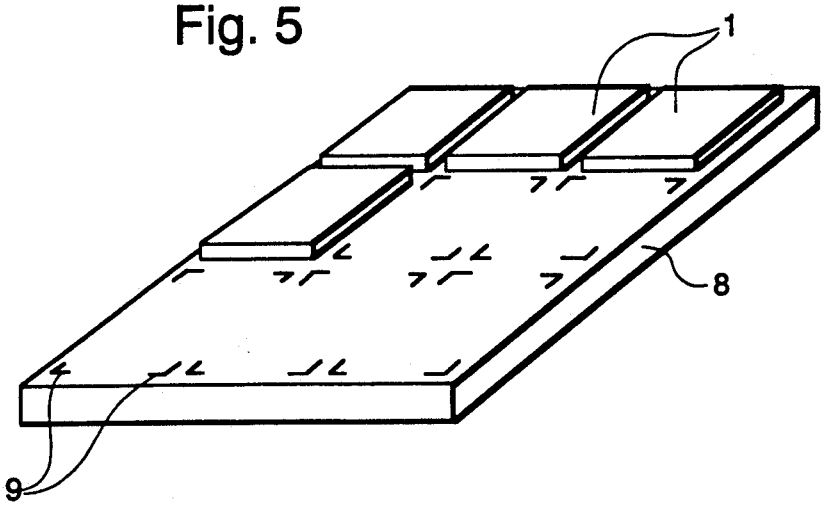
FIG. 5 is a cross-sectional view of a fourth embodiment of the present invention.

In another embodiment shown in FIG. 5, the conformable layer 8 has alignment marks 9 on the upper exposed surface. The tiles 1 are bonded to the conformable layer in alignment with the marks to give a pleasing decorative appearance and a discontinuous wear surface. The discontinuities improve flexibility of the floor covering and may extend down to a micron scale.

The following examples, while not intended to be exhaustive, illustrate the practice of the invention.

Procedure for the Preparation of Vapor Deposited Coatings

Coating Materials

Metals and metal oxides were obtained in 99.9% nominal purity from standard industrial sources. Water was removed from gases using molecular sieve traps. $Al_2O_3$ (99.99%) and $SiO_2$ (99.99%) were obtained from E. M. Industries; Zr02 (99.7%) and $Ta_2O_5$ (99.8%) was obtained from Cerac, Inc.; $TiO_2$ (99.9%), was obtained from Pure Tech, Inc.

Apparatus

The deposition system (Denton DV-SJ/26) included a 66 cm wide high vacuum bell-jar assembly; a high speed pumping system (CTI Cryogenics CT-10 cryopump and Alcatel ZT 2033 mechanical pump); an electron-beam vaporization source (Temescal STIH-270-2MB four-hearth "Supersource", with an 8 kWatt Temescal CV-8 high-voltage controller and e-beam power supply and Temescal XYS-8 sweep control); a resistively heated vaporization source (Denton Vacuum, 4kWatt); a cold cathode ionization source (Denton Vacuum model CC101 with both CC101BPS and CC101PS biased and unbiased power supplies); a residual gas analyzer (Inficon Quadrex 200); a quartz crystal type deposition rate controller (Inficon IC6000); four eight inch circular deposition targets affixed to a planetary rotation sub-system; and a 10" diameter stainless steel aperature for focusing the e-beam (or thermally) evaporated material and the ion plasma on the same deposition surface. The various power supplies, pressure and gas flow monitors were operated either automatically using Denton's customized process control system, or manually. Typically, a deposition run began with an automated pump-down process, was followed by a deposition process controlled by the IC6000 and ended with an automated venting cycle.

Deposition Process

The following general procedure was followed for all deposition runs. Following evacuation to $\leqq 1.0\times10^{-5}$ Torr the temperature of the chamber, as measured by a centered thermocouple at planet level, was adjusted to the desired deposition temperature and the planetary rotation was started. Next, Ar gas was admitted to increase the chamber pressure to about $1\times10^{-4}$ Torr, and a plasma 300–600 mAmps/300–600 Volts was initiated at the cold cathode source (current density between 95 and 500 uamps/cm$^2$) which was used to sputter-clean the substrates, in situ, for five minutes. The deposition process was thereafter controlled by an IC6000 process which typically included parameters such as heating rates and times, material densities, desired deposition rates and thicknesses, and the number of layers desired.

Prior to deposition, the substrates were shielded from the metal, or metal oxide source. Ion bombardment with an ion plasma began and the shields were removed simultaneously when the IC6000 signalled that the metal or metal oxide had been heated to the temperature appropriate for vaporization. A quartz crystal microbalance provided input for the IC6000 feedback loop system which provided deposition rate control for the remainder of the process. After deposition of a specified thickness, the ion source was turned off, the shields replaced, and the vapor sources allowed to cool.

Rupture Strain Test for Thin Ceramic Coatings

One surprising feature of the present invention is the rupture strain of the thin hard inorganic coatings of the present invention. Obtaining the rupture strain of a thin, hard inorganic film or coating such as a ceramic is a difficult task as the coating is not thick enough to be self-supporting to be tested with conventional apparatus. Among the properties of yield stress, yield strain, modulus of elasticity, rupture or ultimate strain and Poisson's ratio, the yield strain is of most importance as the wear layer will undergo strain as determined by the underlying load support structure. To create a support structure, it is necessary to determine how much strain can be tolerated by the wear layer and then make design adjustments of the support parameters so that this strain will not be attained in service.

Ceramics are brittle and characteristically, the yield strain is close to, and in a practical sense, is equal to the ultimate or rupture strain. A ductile region does not exist between yield and rupture. This condition makes the test more definitive as rupture is more readily detected than yield, i.e., a crack is observed at the ultimate strain or rupture.

An evaluative test for measuring the ultimate strain to brittle fracture in a thin ceramic film was developed. The test is parasitic in that it relies on a host to produce the elongation strain in the ceramic coating. A thin, highly tempered steel strip is coated with a very much thinner coating of the wear layer (ratio of thicknesses of 250 to 1). The steel strip is bent in a cantilever fashion and being so thick compared to the coating, its bending performance is not affected by the presence of the coating. By measuring the deflection of the cantilever, the surface strain of the bent steel can be calculated by elastic mechanics equations. The coating will experience the same elongation strain as the surface of the steel. The beam is progressively deflected increasing the surface strain of the steel. When the rupture strain of the coating is attained, the coating ruptures by cracking which is visually evident. Measurement of the deflection of the beam and the position along the beam where the crack occurred are sufficient data to calculate the strain when the crack occurred.

The credibility of the test is dependent upon the following items: (1) the coating must be 100% and adhered to the cantilever surface, (2) the deflection of the beam must be small to insure accuracy with use of elastic beam formulae and (3) the yield strain of the cantilever beam must be greater than the rupture strain of the coating.

The detection of a crack and its position must be accurately determined. Detection of a crack in a three micron transparent film requires scrutiny. Observance at 40 x magnification and illumination by collimated light appears to be necessary to discover the existence of a typical tension crack.

Figure 6:
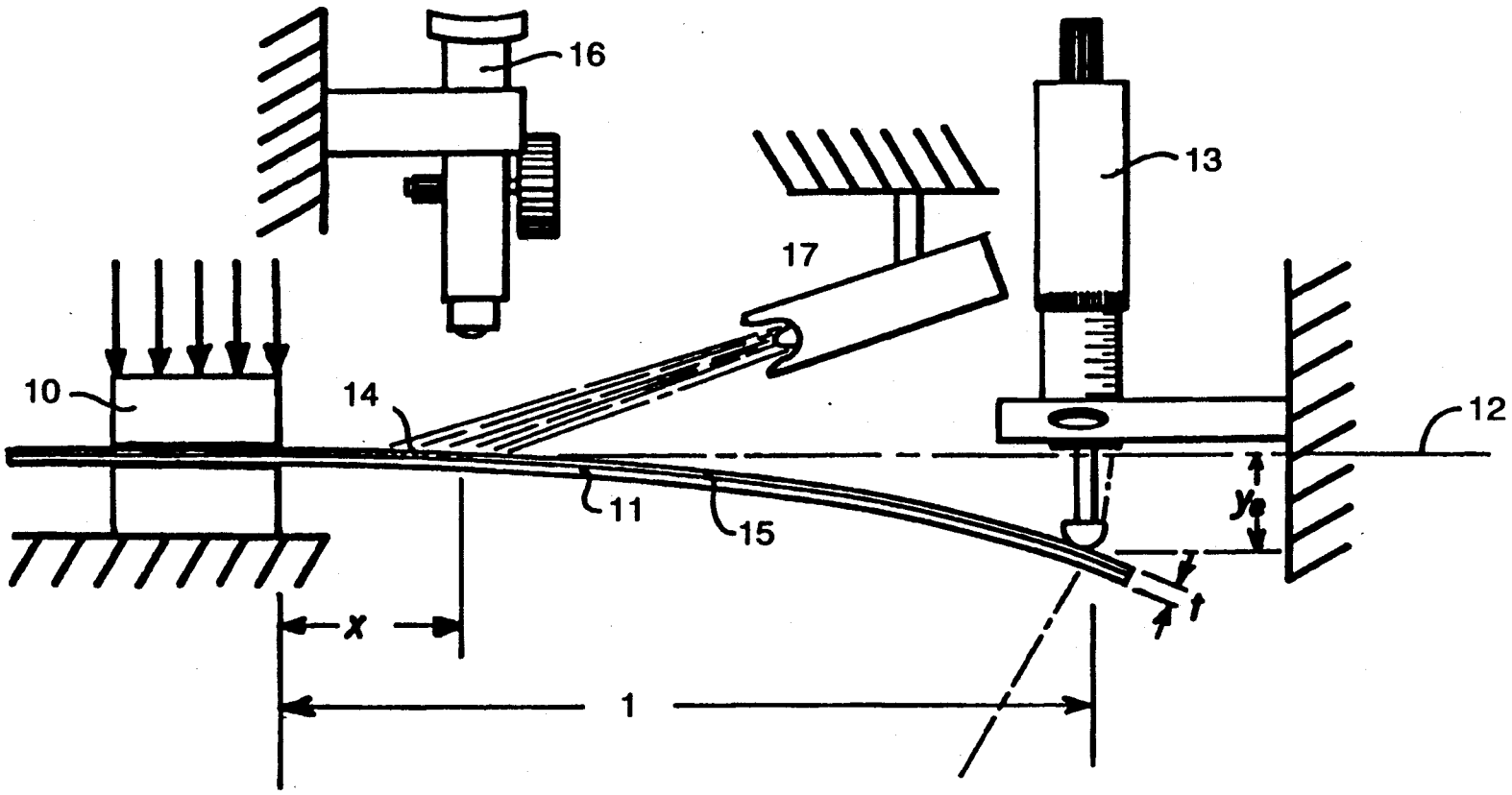
FIG. 6 is a schematic representation of test setup to measure rupture strain.

FIG. 6 depicts the instrument setup to detect and measure the position of the rupture cracks in the wear layer coating. The clamp 10 holds the specimen 11 in a horizontal reference plane indicated by dashed line 12. Micrometer 13 both deflects and measures the distance of deflection $y_e$. The cracks 14 in the wear layer 15 are observed with the aid of microscope 16 and collimated light source 17.

The length of the beam and its thickness are interrelated and wide variations of the two are possible. A length of two inches and a thickness of 0.030 inches has been found suitable for creating observable strain cracking of the wear layer. The test procedure is also usable in evaluating compressive surface strains by simply mounting the beam so that the bending places the coating in compression, i.e., inverting. The unit then deflects up, not down. The percent surface strain at position X, $e_x$, is calculated by the following formula:

$$e_x = \frac{3t(1 - x)y_e}{2l^3} \cdot 100\%$$

Test evaluation of the method and instrumentation was done on one half inch wide specimens with a standard coating of 3 microns of $Al_2O_3$. Specimens 1 to 4 were coated by the procedure set forth above.

Specific values of these coating operations are as follows:

| Specimen | l inch | t inch | Crack Observed % Strain @ Rupture (Calculated) |
|---|---|---|---|
| 1 | 1.75 | 0.030 | 0.60% |
| 2 | 1.75 | 0.030 | 0.71% |
| 3 | 2.50 | 0.024 | 0.56% |
| 4 | 2.25 | 0.030 | 0.33% |
| 5 | 2.50 | 0.031 | >0.58% |

Two factors that contribute to the high strain value are:

1. The coating is not a single crystal as it is deposited in a layer form which builds in some form of voids. This is evidenced by repeated measurements of deposit density of 160 lbs. per cubic ft. as contrasted to 247 lbs. per cubic ft. for single crystal sapphire. The coating structure conceivably has more extensibility before rupture.

2. This test detects elongation strain-to-rupture on the as-deposited-coating. The deposited coating may not and probably is not residual-strain-free. Other sources of information and papers on deposition cite conditions creating high compression or tension deposition strains. If the coating is deposited with compressive strains, these strains must be diminished to zero by bending before actual tension strains are created. Thus if the coating were under compression from deposition, this test would measure the sum of the residual compressive strain plus the actual tension strain to failure.

Samples 1 to 4 present a range of as-deposited strain-to-rupture of 0.3 to 0.7%. The variation of strain of several samples from any one coating operation has been experimentally found to be =0.1%. This suggests that there were either variations in the coating structure or residual strains in the samples tested.

Analysis of the cracking behavior and patterns discloses characteristics of the coating. The observed cracking has been "instantaneous" which is typical of a brittle ceramic so that one can conclude that cracks will propagate once started. The cracks for these samples produced under progressive deflection were all perpendicular to the generated tensile stress, were all parallel, and were surprisingly uniformly spaced one from the other. The spacing was small averaging four tenths of a mil apart. This indicates a tightly bonded, uniform coating as no delamination occurred and the cracking progressed in repetitive fashion.

The cracks in the samples 1 and 2 were evident in the deflected beam but could not be observed (at 40×) when the beam was removed from the instrument and returned to the flat condition. Having cracked and being a ceramic, the cracks cannot heal to a once-again continuous surface. A machinist's dye on the surface did not make the cracks visible. This suggests that the cracks were pushed together tightly when the specimen was returned to flat and that there was no debris thrown off from the edges of the crack. It could be surmised that the coating was under residual compression strains when deposited.

EXAMPLES 1-1 to 1-36

The following are examples of hard inorganic materials which have been deposited on various substrates:

TABLE 1

| Example No. | Film Mat'l. | Substrate Material | Thickness (u) | No. of Film Layers |
|---|---|---|---|---|
| 1-1 | $SiO_2$ | SS[1] foil | 10.4 | 11 |
| 1-2 | $SiO_2$ | SS foil | 7.9 | 1 |
| 1-3 | $ZrO_2$ | SS foil | 2.5 | 1 |
| 1-4 | $Al_2O_3$ | SS foil | 0.5 | 1 |
| 1-5 | $Al_2O_3$ | SS foil | 1.5 | 2 |
| 1-6 | $ZrO_2$ | SS foil | 4.8 | 1 |
| 1-7 | $Al_2O_3$ | SS foil | 5.4 | 1 |
| 1-8 | $Al_2O_3$ | Ferroplate | 11.3 | 32 |
| 1-9 | $Al_2O_3$ | Ferroplate | 3.2 | 26 |
| 1-10 | $Al_2O_3$ | Ferroplate | 6.7 | 52 |
| 1-11 | $Al_2O_3$ | Ferroplate | <1.0 | 1 |
| 1-12 | $Al_2O_3$ | Ceramic Tile | 1.0 | 1 |
| 1-13 | $Al_2O_3$ | Ceramic Tile | | 32 |
| 1-14 | $Al_2O_3$ | Brass Ferroplate | 1.0 | 1 |
| 1-15 | $Al_2O_3$ | Brass Ferroplate | | 20 |
| 1-16 | $Al_2O_3$ | Brass/Ferroplate | | 29 |
| 1-17 | $Al_2O_3$ | Steel/Ferroplate | | 1 |
| 1-18 | $Al_2O_3$ | Steel/Ferroplate | | 20 |
| 1-19 | $Al_2O_3$ | Steel/Ferroplate | | 29 |
| 1-20 | $Al_2O_3$ | ⅛" Thick 01 Steel | | 1 |
| 1-21 | $Al_2O_3$ | ⅛" Thick 01 Steel | | 29 |
| 1-22 | $Al_2O_3$ | ⅛" Thick 01 Steel | | 32 |
| 1-23 | $Al_2O_3$ | TEOS[2]/Ceramic Tile | 0.1 | 1 |
| 1-24 | $Al_2O_3$ | TEOS/Ceramic Tile | 0.2 | 1 |
| 1-25 | $Al_2O_3$ | TEOS/Ceramic Tile | 0.5 | 10 |
| 1-26 | $ZrO_2$ on $Al_2O_3$ | Ferrosteel | 0.1 | 1 |
| 1-27 | $Al_2O_3$ | Ceramic Tile | 1.2 | 3 |
| 1-28 | $Al_2O_3$ | Brass Ferroplate | 1.2 | 3 |
| 1-29 | $Al_2O_3$ | Brass Ferroplate | 1.0 | 1 |
| 1-30 | $TiN_x$ | Ferro Steel | 0.3 | 1 |
| 1-31 | $TiN_x$ | Ferro Steel | 1.0 | 1 |
| 1-32 | $TiN_x$ | Ferro Steel | 1.9 | 1 |
| 1-33 | $SiO_2$ | Ferro Steel | 1.1 | 1 |
| 1-34 | $Al_2O_3$ | Marble | 3.0 | 1 |
| 1-35 | $TiN_x$ | Marble | 2.4 | 1 |
| 1-36 | $TiN_x$ on $Al_2O_3$ | Marble | ⅛ | 2 |

[1]Stainless Steel
[2]Tetraethylorthosilicate

Samples approximately six inches square were tested in the Walkers Test in which six female walkers reached a total traffic count of 1200.

On matte finish, hard (manufacturer's ratings of Mohs 6.5 and 8.5) ceramic tiles, aluminum oxide coating did not scratch to a significant extent. Increased damage occurred in samples where the aluminum oxide was deposited onto ceramic substrates with Mohs hardness less than 6.5.

On hard, shiny ceramic tile, aluminum oxide performed well. On softer, unglazed tile, the coating appeared to provide protection against large scratches during the first half of the test, and at the end of the test there were fewer (but noticeable) scratches on the coated than on the uncoated samples. The aluminum oxide coating prevents the formation of haze (multiple fine scratches) on brass ferroplate. On ferroplate, application of aluminum oxide at 140° C. produced a coating that performed as well as one applied at 250° C. The best ferroplate samples were ones coated when other types of samples were not in the chamber.

When aluminum oxide was applied to a shiny ceramic tile that was essentially not scratched in its uncoated state (and on which scratches, if present, could be readily seen), the coating performed almost as well as the uncoated tile. The coated tile had two fairly large, almost scuff-like scratches but otherwise was essentially as good as the uncoated tile.

Under the same test conditions, the coated ferroplate samples—although exhibiting complete resistance to multiple fine scratches—had a number of large scratches on them. The ferroplate samples with the most scratches were those prepared at the same time as samples other than ferroplate. These results hint that the coating may be adversely affected by contaminants from the other samples.

On softer, unglazed tile, the coating appeared to protect the tile from large scratches during the first half of the test. At the end of the test, there were fewer but more noticeable scratches on the coated, with coating removed along the scratches.

EXAMPLES 2-1 to 2-8

Performance of vapor-deposited aluminum oxide was evaluated using the Walker Test. Under these test conditions, the aluminum-oxide-coated ferroplate samples with the thicker coatings were the best performing flooring prototypes. The only samples to retain their gloss in all areas were those with vapor-deposited aluminum oxide coatings at least 2.5 microns thick on ferroplate. The principal damage to these samples consisted of medium and large scratches.

Samples approximately six inches square were tested in the Walkers Test in which six female walkers reached a total traffic count of 1236.

Because the samples were only six inches square, the walkers either placed a single foot on each sample or had to make a special effort to place both feet on each sample. It was observed that when they placed both feet on a sample, they usually placed their feet on diagonally opposite quadrants of the sample. This produced on most samples two areas which were much more worn than other areas. See results in Table 2.

TABLE 2

| Example No. | Support Substrate | Wear Layer | No. of Layers | $Al_2O_3$ ThK. Total, u | Comments |
|---|---|---|---|---|---|
| 2-1 | Brass | $Al_2O_3$ | 1 | 0.3 | Purple-blue color; many |

TABLE 2-continued

| Example No. | Support Substrate | Wear Layer | No. of Layers | $Al_2O_3$ ThK. Total, u | Comments |
|---|---|---|---|---|---|
| | Ferroplate | | | | fine scratches and very dull sections throughout sample; $Al_2O_3$ appeared to be removed by traffic in 2 quadrants |
| 2-2 | Brass Ferroplate | $Al_2O_3$ | 1 | 0.5 | Green to colorless; some fine scratches, some larger scratches, no dull areas $Al_2O_3$ appears to be intact |
| 2-3 | Brass Ferroplate | $Al_2O_3$ | 1 | 1.0 | Pink to colorless; many fine scratches, $Al_2O_3$ partly removed (uniformly) |
| 2-4 | Brass Ferroplate | $Al_2O_3$ | 5 | 2.0 | Some fine scratches, most damage was large-sized scratches; good gloss retention |
| 2-5 | Brass Ferroplate | $Al_2O_3$ | 2 | 2.0 | More fine scratches than 2-4; some large size scratch damage |
| 2-6 | Brass Ferroplate | $Al_2O_3$ | 1 | 3.2 | Almost no fine scratches, some large size scratches |
| 2-7 | Brass Ferroplate | $Al_2O_3$ | — | 2.5 | Almost no fine scratches, all damage |
| 2-8 | Brass Ferroplate | $Al_2O_3$ | 1 | 3.2 | medium to large scratches |

The performance of aluminum-oxide-coated ferroplate with a coating at least 2.5 microns thick was superior to commercial wear layers. The only samples to retain their gloss in all the pivot areas were those with aluminum oxide coatings at least 2.5 microns thick on ferroplate. The principal damage to these samples consisted of a number of medium and large scratches, each one of which is individually visible.

Indentations produced by spike heels on the aluminum-oxide-coated ferroplate did not cause macrocracking. Small parallel cracks were formed in the indentation but do not extend appreciably beyond the indentation.

EXAMPLE 3

In this example, use of an ion gun during $Al_2O_3$ deposition did not significantly affect gloss retention—for these flooring structures. Use/nonuse of the ion gun during $Al_2O_3$ depositions on ceramic decal/steel substrates generally has no significant effect on Walker Test performance.

The performance level of the $Al_2O_3$ coated ceramic decal decorated steel structures was limited by the spalling of the ceramic decal at its interface with the steel support. Three-layer ceramic decal samples on 7-mil steel had fewer scratches than the coated single layer ceramic decal/steel samples. The triple-decal samples were more severely marred due to their greater tendency toward spalling.

Samples approximately six inches square were tested in the Walkers Test. Table 3 lists average gloss readings.

$Al_2O_3$ wear layers were evaporated by the e-beam gun without the use of crucible liners. The chamber was baked out at 250° C. for 1 to 3 hours prior to each deposition to minimize water vapor contamination. The substrate temperature was allowed to "float" starting at 30°-90° C. during the deposition runs. For depositing done without the ion gun an $O_2$ atmosphere of approximately $2.3\times10^{-4}$ Torr was maintained.

The Decal used was #A2894 with ceramic overglaze colors, obtained from Philadelphia Decal. The steel was 7 mil stainless steel, obtained from Lyon Industries.

TABLE 3

| No. of Passes | Single Decal Ion Gun | | Single Decal No Ion Gun | | Triple Decal Ion Gun | | Triple Decal No Ion Gun | |
|---|---|---|---|---|---|---|---|---|
| | Initial | Final | Initial | Final | Initial | Final | Initial | Final |
| 0 | — | 81.3 | — | 81.1 | — | 96.6 | — | 96.9 |
| 24 | 84.5 | 75.8 | 83.4 | 72.3 | 97.1 | 92.3 | 99.4 | 93.5 |
| 48 | 84.1 | 83.8 | 81.6 | 78.6 | 96.4 | 96.0 | 96.4 | 97.8 |
| 102 | 79.0 | 77.2 | 82.3 | 82.7 | 96.0 | 97.9 | 94.7 | 95.1 |
| 204 | 85.2 | 83.4 | 83.1 | 83.2 | 97.9 | 97.2 | 95.9 | 95.4 |
| 402 | 75.1 | 76.8 | 75.9 | 73.9 | 94.5 | 88.4 | 95.8 | 95.0 |
| 804 | 80.5 | 79.9 | 80.0 | 78.8 | 95.8 | 98.7 | 96.4 | 91.3 |
| 1200 | 80.5 | 81.0 | 81.4 | 76.6 | 98.2 | 88.3 | 100.0 | 91.6 |

EXAMPLES 4-1 to 4-23

Evaluations were made of (a) alumina on a stiff but flexible substrate, (b) coatings prepared with and without the ion gun, and (c) layered coatings.

Alumina (2–4 microns) on a flexible but stiff substrate (3-, 5-, or 7-mil tempered steel) did not crack in the Walkers Test when (1) the resulting laminate was supported by a deformable rubber (Shore hardness 70) and (2) even when high heels were included in the Walkers Test. The laminate resisted fine scratches, in a manner similar to ferroplate tested earlier, but the severity of individually visible scratches was accentuated by failure of adhesion. The failure was not, however, between the substrate and coating but rather between the substrate and a purplish layer that was formed on the substrate.

The performance in the Walkers Test of alumina on ferroplate was greatly improved by use of the ion gun during deposition.

The standard, single-layer, alumina coating retained its appearance better than any of the layered coatings. The 18-layer chromium/alumina coating was a brilliant magenta.

In Table 4 are listed the substrates and comments on the appearance of the samples after trafficking.

TABLE 4

| Example No. | Substrate | Support Layer | Film Material | No. of Layers | Total Thickness (SEM, microns) | Comments |
|---|---|---|---|---|---|---|
| Control 4-1 | 5-mil Shim | Silicone Rubber | Uncoated | | | Matted. A number of individual scratches. A few heel dents. |
| Control 4-2 | 7-mil Uncoated | Rubber | | Matted. A number | | of individual scratches. No heel dents. |
| Control 4-3 | 5-mil Shim | Tile | Uncoated | | | Similar to above 5-mil control. |
| Control 4-4 | 7-mil Shim | Tile | Uncoated | | | Similar to above 7-mil control. |
| 4-1 | 3-mil Shim Stock | Silicone Rubber | $Al_2O_3$ | 1 | 4.0 | Two-piece sample. No matting. A number of individual scratches. Some delamination along center seam. Scratches accentuated by adhesive failure. One heel penetration. |
| 4-2 | 5-mil Shim Stock | Silicone Rubber | $Al_2O_3$ | 1 | 4.0 | No delamination. No matting. Much less scratching than Example 4-1. Only a few barely discernible heel dents. Scratches accentuated by adhesive failure. |
| 4-3 | 7-mil Shim Stock | Silicone Rubber | $Al_2O_3$ | 1 | 4.0 | No delamination. No matting. Fewer scratches than Example 4-2. No discernible heel dents. |
| 4-4 | Steel Ferro | Tile | $Al_2O_3$ | 1 | 4.0 | No matting. A number of heel dents. Number of scratches less than Example 4-2 but more than Example 4-1. |
| 4-5 | 3-mil Shim Stock | Silicone Rubber | $Al_2O_3$ | 1 | 4.1 | Two-piece sample. No matting. No delamination. Slightly fewer scratches than Example 4-2. Scratches accentuated by adhesive failure. A number of heel dents. |
| 4-6 | 5-mil Shim Stock | Silicone Rubber | $Al_2O_3$ | 1 | 4.1 | Similar to Example 4-2. |
| 4-7 | 7-mil Shim Stock | Silicone Rubber | $Al_2O_3$ | 1 | 4.1 | No matting, no delamination. Many scratches which are accentuated by adhesive failure. |
| 4-8 | Steel Ferro | Tile | $Al_2O_3$ | 1 | 4.1 | Similar to Example 4-4. |
| 4-9 | 3-mil Shim Stock | Tile | $Al_2O_3$ | 1 | 2.1 | No matting. Slight delamination at multiple scratches. Significantly more scratches than Example 4-5. Scratches accentuated by adhesive failure. |

TABLE 4-continued

| Example No. | Substrate | Support Layer | Film Material | No. of Layers | Total Thickness (SEM, microns) | Comments |
|---|---|---|---|---|---|---|
| 4-10 | 5-mil Shim Stock | Tile | $Al_2O_3$ | 1 | 2.1 | Similar to Example 4-6, but slightly fewer scratches. |
| 4-11 | 7-mil Shim Stock | Tile | $Al_2O_3$ | 1 | 2.1 | No matting, no delamination. Fewest scratches of any shim stock sample. Scratches accentuated by adhesive failure. |
| 4-12 | Steel Ferro | Tile | $Al_2O_3$ | 1 | 2.1 | Similar to Example 4-4. |
| 4-13 | 3-mil Shim Stock | Tile | $Al_2O_3$ | 1 | 3.1 | No matting, some delamination. Second most scratches. |
| 4-14 | 5-mil Shim Stock | Tile | $Al_2O_3$ | 1 | 3.1 | Most scratches of any shim stock sample. |
| 4-15 | 7-mil Shim Stock | Tile | $Al_2O_3$ | 1 | 3.1 | More scratches than Example 4-11. |
| 4-16 | Steel Ferro | Tile | $Al_2O_3$ | 1 | 3.1 | Similar to Examples 4-4. |
| 4-17 | Steel Ferro | Tile | $Al_2O_3$ | 1 | 3.0 | Similar to Example 4-4. |
| 4-18 | Steel Ferro | Tile | $Al_2O_3$ | 1 | 3.0 | Similar to Example 4-4. |
| 4-19 | Steel Ferro | Tile | $Al_2O_3$ | 1 | 3.0 | Large areas delaminated (before test). Delamination along scratches. |
| 4-20 | Steel Ferro | Tile | $SiO/Al_2O_3$ | 5/5 | 2.0 | Some matting, many scratches. |
| 4-21 | Steel Ferro | Tile | $SiO/Al_2O_3$ | 5/5 | 2.0 | No matting but many deep scratches. |
| 4-22 | Steel Ferro | Tile | $Cr/Al_2O_3$ | 9/9 | 5 | Magenta. Worn thru on a pivot point. Delamination around pivot point. |
| 4-23 | Steel Ferro | Tile | $Al/Al_2O_3$ | 3/3 | 1.5 | Matted areas. Many scratches including very fine scratches. |

The $Al_2O_3$ metallic laminate was sufficiently flexible that it could be bent around a 2-inch mandrel without the $Al_2O_3$ cracking, even when the $Al_2O_3$ was on the convex side. The optimum thickness of the substrate layer appears to be 5 to 7 mils; the 3-mil substrate could be pierced by high heels.

The alumina prevented the formation of fine scratches on the shim steel. The severity of individually visible scratches was accentuated on the coated samples by adhesive failure.

The use of the ion gun during deposition improved the performance of alumina on ferroplate. The sample prepared without the ion gun had many more scratches, significant adhesion failure along the scratches, and an area about $1\times2\frac{1}{2}$ inches that delaminated before the test.

The 18-layer chromium/alumina coating was a brilliant magenta. The coating was 5 microns thick, so this situation was different than one in which thin coatings exhibit interference patterns.

The standard coating retained its appearance better than any of the layered coatings (Examples 4-20 to 4-23).

EXAMPLES 5-1 TO 5-15

Outgassing during the deposition process was demonstrated to adversely effect the scratch performance of $Al_2O_3$ thin films. The outgassing species was tentatively identified as water. This problem may be eliminated by addition of a high temperature bake-out cycle to the deposition procedure. Outgassing was shown to affect the scratch performance, and may greatly reduce scratch resistance.

For $Al_2O_3$ deposition, a 3-hour plateau style bakeout at 250° C. suppressed the outgassing sufficiently to prepare films which had reproducible scratch resistance. In the absence of a bakeout, severe outgassing occurred which adversely affected scratch resistance in the $Al_2O_3$ films produced. The outgassing was probably due to thermal desorption of water from $Al_2O_3$ on the walls of the deposition chamber. Direct identification of the outgassing material must await installation of a pressure adapter for the Residual Gas Analyzer. If the bakeout is not feasible due to thermal limitations of the substrate material, then the chamber should be freshly cleaned and lined with new aluminum foil immediately prior to deposition on that substrate.

When the $Al_2O_3$ coated glass substrates from deposition SERIES A (See Table 1) were evaluated in the diamond stylus scratch test, two major observations were noted: both the Load to Incipient Damage (LID), and the type of damage at the LID changed from the first member of the series to the last. The changes were not monotonic from the beginning of the series to the end. For example, the first member of the series (Specimen 10) gave a LID of 50 g due to the appearance of birefringeance along the scratch track made by the diamond in the surface of the alumina. Scratching at loads of up to 95g showed an increase in the birefringeance, but at no point was any film delamination observed. In contrast, for the second member of the series, birefringeance occurred at an LID of 40 g; at 50 g film delamination began and cracks appeared normal to the scratch direction; and at 70 grams chipping was observed. For the third member of the series, delamination and cracking were both observed at an LID of only 25 g, and film decohesion occurred at 40 g. The remaining members of the series were also characterized by low LID's due to delamination, cracking and film decohesion. These observations exemplify a progressive decrease in adhesion between the vapor deposited $Al_2O_3$ and the glass substrates.

TABLE 5

Film Data, Physical and Mechanical Properties

| | SERIES A: Example Number | | | | | | | |
|---|---|---|---|---|---|---|---|---|
| | 5-1 | 5-2 | 5-3 | 5-4 | 5-5 | 5-6 | 5-7 | 5-8 |
| LID[a] (grams) | 50 | 40 | 25 | 30 | 15 | 20 | 15 | 20 |
| Thickness[c] (u) | 3.17 | 3.74 | 3.55 | 4.03 | 3.89 | 4.03 | 4.22 | 3.70 |
| Wt. Dep. (mg) | 15.0 | 17.3 | 16.1 | 1.85 | 1.68 | 1.69 | 1.69 | 1.64 |

| | SERIES B: Example Number | | |
|---|---|---|---|
| | 5-9 | 5-10 | 5-11 |
| LID[a] (grams) | 45 | 40 | 45 |
| Thickness[c] (u) | 3.31 | 2.98 | 3.31 |

| | SERIES C: Example Number | | | |
|---|---|---|---|---|
| | 5-12 | 5-13 | 5-14 | 5-15 |
| LIDa (grams) | 50 | 45 | 45 | 45 |
| Thickness[c] (u) | 4.08 | 3.65 | 3.70 | 3.50 |

[a]Load to Incipient Damage: Damage in excess of simple indentation
[b]Calculated, based on SEM thickness and a coated area of 16.75 $cm^2$
[c]Obtained by Scanning Electron Microscopy

SERIES A

Eight consecutive deposition runs were performed. In each case, substrates in addition to glass substrates were present in the chamber. These substrates included Ferrosteel, 5 mil spring steel, chromed spring steel, thick "01" steel plate (both chromed and untreated), stainless steel, and several engineering plastics. In all but two of the runs in this series, the samples were loaded into the deposition chamber in late afternoon of the working day before the run. For the Examples 5-5 and 5-7, however, the samples were loaded into the deposition chamber in the morning and the system was allowed to pump down over the lunch hour.

SERIES B

Three consecutive deposition runs were performed. These runs contained only glass substrates. The procedure was the same as that for SERIES A except that Example 5-11 was subjected to a three hour bakeout cycle at 250° C. while pumping overnight.

SERIES C

Four consecutive deposition runs were performed. These runs contained additional substrates capable of withstanding a 250° C. heat treatment. For each of these runs the procedure included an overnight bakeout at 250° C.

Diamond stylus scratch test results are reported here as Load to Incipient Damage (LID) to the nearest five grams of stylus weight loading. Because the mechanism of scratching hard inorganic materials does not include any macroscopically observable "recovery" mechanism, Load to Incipient Damage is defined as that weight loading, in the LOM equipped with a 45× objective, where damage other than a simple indentation is observed. For example: the LID may be due to the observation of birefringeance at the edge of the scratch track, by delamination of the film, chipping, or the development of cracks.

Density measurements were obtained by dividing the weight gain of a Ferrosteel slide by the area exposed for deposition (16.75 $cm^2$) and the film thickness as determined by SEM. Control experiments showed that there was no detectable weight loss due to sputtering even after 20 minutes exposure to a 600mA/600V $Ar^+$ ion plasma. In addition, a Ferrosteel slide subjected to the entire deposition cycle but shielded from deposition experienced no detectable weight change.

A clue into the cause of these adhesive differences was offered by a qualitative comparison of Ion Gun voltage during the first few moments of several of the SERIES A deposition runs. A high bombardment voltage was attained immediately at the start of the deposition run and the voltage was sustained throughout the run. However, voltage dropped at the onset of deposition, and progressively longer times were required to reach and sustain an ion voltage of 600 volts. Two important facts are associated with this observation. First, the ion gun voltage is inversely proportional to the chamber pressure. Thus a voltage drop is accompanied by a pressure surge. Second, $Al_2O_3$ films prepared using a high voltage ion assist outperform those prepared with no ion assist. Therefore, a pressure surge accompanied by a voltage drop will adversely effect the wear performance of such a film.

The progressive nature of the deterioration in LID performance suggested an impurity buildup as a function of chamber use. Thus it was proposed that excess alumina deposited on the chamber walls gettered water vapor from the laboratory atmosphere whenever the chamber was opened to install or remove substrates. Aluminum oxide is a well known desiccant which is activated by heat treatment in a vacuum. Radiation from the e-beam evaporation source probably "activated" alumina which had accumulated on the chamber walls during previous runs and caused the observed pressure surges. Direct verification of this hypothesis using the Residual Gas Analyzer (RGA) was not possible because of its pressure limitation.

The first indirect confirmation that water vapor was being desorbed was obtained using the RGA under predeposition conditions. The RGA, upon evacuation of the chamber to a pressure of $10^{-6}$ Torr showed a constant (uncalibrated) water vapor pressure of $5\times10^{-5}$ Torr. When the quartz heaters in the chamber were energized, however, an immediate pressure surge due to an increase in water vapor pressure was observed. Unfortunately, the cutoff pressure for the RGA is $10^{-4}$ Torr, which is the vapor pressure in the chamber during most deposition runs. Therefore, the RGA cannot be used during the runs to directly confirm the water vapor hypothesis.

A second indirect confirmation of the role of water vapor during the deposition process was obtained by examination of the scratch test results obtained from deposition SERIES B (see Table 1). The first two depositions in this series were run on consecutive days, under the same conditions as the first two members of SERIES A. For the first two deposition runs in both SERIES A and SERIES B, trends showing a decrease in scratch LID, and an increase in voltage stabilization time was observed (the magnitude of the pressure surge was mitigated by the chamber operator decreasing the flow rate through the ion gun). Addition of a bakeout cycle to the deposition procedure for the third deposition run in SERIES B resulted in recovery of the scratch behavior observed in the first members of both SERIES A and B, and decreased the time required to obtain a stable ion gun voltage.

SERIES C was run in order to test the reproducibility of scratch tests obtained from runs which included the bakeout cycle. In contrast to SERIES A, no significant change in scratch performance from the beginning of SERIES C to the end was observed.

The early moments of the deposition runs in SERIES C were not accompanied by the voltage drops and pressure surges that were observed in SERIES A. Also no change was shown in the type of scratch damage observed at the LID.

Examples 6-1 TO 6-14

Increasing the thickness of the decorative layer improved the performance of the glass and ceramic decals, both coated and uncoated except that of the 20-micron thick glass decorative layers. Coating the decorative layer with aluminum oxide improved the overall appearance retention in all cases. The failure mode for the glass and ceramic decals appears to be different. Diamond stylus scratch tests show that the glass decorative layer crumbles under relatively high stylus load where the ceramic decorative layer chips.

In previous Walkers Tests, the decorative layer which consisted of 5-micron-thick glass decals, showed large individually discernible scratches that broke through to the metal substrate. Since the decorative layer also supports the aluminum oxide layer a thicker glass layer should provide better support. Samples made by layering glass decals were run in the Walkers Test to test this idea.

The glass-ink decal has a nano-hardness of 6 Gpa. The best aluminum oxide has a nano-hardness of 10 Gpa. There exist ceramic inks which form harder decorative layers than the glass inks. These ceramic inks have a nano-hardness value of 11 Gpa. Decals made from these ceramic inks not only should provide better support for the aluminum oxide layer but conceivably could act as a wear layer itself. Single and multiple layer samples were prepared to evaluate the effect of thickness on performance.

Samples approximately six inches square were tested in the Walkers Test. The samples were supported by a vinyl base tile to which they were attached by adhesive transfer tape. Six walkers reached a total traffic count of 1200.

Before and after trafficking, sixty-degree gloss measurements were made with the Mallinckrodt Glossmeter. A measurement was made at the center and at the center of each of four quadrants of the sample for a total of five measurements.

Sample descriptions and gloss values are listed in Table 6. The glass decals were 5 microns thick. The ceramic decals were 10 microns thick.

TABLE 6

| Sample No. | Sample Descriptions | Gloss Values Initial | Gloss Values Final |
|---|---|---|---|
| 6-1 | 1 layer glass decal/7 mil 302 steel | 70 | 60 |
| 6-2 | Aluminum oxide coated 1 layer glass decal/7 mil 302 | 53 | 54 |
| 6-3 | 2 layer glass decal/7 mil 302 steel | 96 | 70 |
| 6-4 | Aluminum oxide coated 2 layer glass decal/7 mil 302 | 63 | 59 |
| 6-5 | 3 layer glass decal/7 mil 302 steel | 110 | 86 |
| 6-6 | Aluminum oxide coated 3 layer glass decal/7 mil 302 | 86 | 85 |
| 6-7 | 4 layer glass decal/7 mil 302 steel | 83 | 37 |
| 6-8 | Aluminum oxide coated 4 layer glass decal/7 mil 302 | 73 | 58 |
| 6-9 | 1 layer ceramic decal/7 mil 302 steel | 78 | 67 |
| 6-10 | Aluminum oxide coated 1 layer ceramic decal/7 mil 302 | 78 | 72 |
| 6-11 | 2 layer ceramic decal/7 mil 302 steel | 87 | 84 |
| 6-12 | Aluminum oxide coated 2 layer ceramic decal/7 mil 302 | 90 | 90 |
| 6-13 | 3 layer ceramic decal/7 mil 302 steel | 89 | 80 |
| 6-14 | Aluminum oxide coated 3 layer ceramic decal/7 mil 302 | 92 | 91 |

Increasing the thickness of the decorative layer improved the performance of the glass and ceramic decals, both coated and uncoated. The sample with the best appearance and gloss retention was the aluminum oxide-coated triple-layer (30 micron) ceramic-decal sample. In general, the multilayer ceramic decals resisted large scratches better than the multilayer glass decals.

Coating the decorative layer with aluminum oxide improved the overall appearance and gloss retention in all cases except that of the 5- and 10-micron thick glass decorative layers. The aluminum oxide coating improved the gloss retention of both systems, with the coated ceramic decal having the best gloss retention. On the ceramic decals, the aluminum oxide reduced the number of large scratches. On the glass decals, the aluminum oxide reduced the number of small scratches. With the ceramic decals, some of the scratches appeared confined to the aluminum oxide coating.

The ceramic decals appeared to adhere less well to the steel than did the glass decals. At 10 microns, the ceramic decals resisted fine scratches better than the glass decals but had more scratches to the metal. At 20 microns, the ceramic decals resisted both fine and large scratches better than the glass decals but still had more scratches to the metal. The chipping around the area of the scratches in the ceramic decals, seems to indicate an adhesion failure, possibly due to differences in the coefficient of thermal expansion.

The failure mode for the glass and ceramic decals appeared to be different. Diamond stylus scratch tests on the same samples that made up this Walkers Test showed that at relatively high loads (60–95 grams), the glass decals tended to crumble where the ceramic decals did not. The crumbling decal left granules of material on either side of the scratch. In the multi-layer ceramic decal samples any failure noted could be described as a chipping failure. The scratch from the stylus looked similar to aluminum oxide scratches but had intermittent areas where the ceramic ink chips away from the rest of the coating. It appeared that the ceramic ink in the decorative layer had a greater inherent strength than the glass ink. However, when stressed to the point of failure, the ceramic ink exhibited a brittle failure where the glass crumbled.

EXAMPLES 7-1 TO 7-8

Addition of a ceramic primer to the composite structure eliminated the spalling of the decorative layer seen in previous walker testing. Damage was limited to large, individually visible scratches and can be grouped into three types: (a) damage to the $Al_2O_3$ layer only; (b) damage to the decorative layer; and (c) damage to the metal substrate. There was no deglossing due to fine scratches. The two ceramic primers performed equally well.

Samples were tested in the Walkers Test. Table 7 lists the sample data and the gloss values as measured. Two ceramic/metal composite categories were tested. They were: (1) $Al_2O_3$-coated ceramic decal on H34001 primer on 7 mil 302 steel; and (2) $Al_2O_3$-coated ceramic decal on J-M600001 primer on 7 mil 302 steel.

TABLE 7

| Description | Sample No. | $Al_2O_3$ Thk.[3] (micron) | Walker Cycles | 60° Gloss Initial | 60° Gloss Final |
|---|---|---|---|---|---|
| $Al_2O_3$/Ceramic Decal/ H34001 Primer[1] | 7-1 | 4.8 | 400 | 89.4 | 81.0 |
| | 7-2 | 4.8 | 800 | 88.8 | 79.3 |
| | 7-3 | 4.8 | 1200 | 86.1 | 84.4 |
| | 7-4 | 3.8[3] | 1200 | 85.6 | 80.8 |
| $Al_2O_3$/Ceramic Decal/ J-M600001 Primer[2] | 7-5 | 4.3[4] | 400 | 98.2 | 91.9 |
| | 7-6 | 3.8[3] | 800 | 94.2 | 90.1 |
| | 7-7 | 4.3[4] | 1200 | 97.5 | 90.0 |
| | 7-8 | 4.3[4] | 1200 | 95.6 | 89.7 |

[1]Manufactured by Heraeus, Inc.
[2]Manufactured by Johnson Matthey
[3]Light optical microscope thickness determination.
[4]Average of four SEM measurements.

EXAMPLES 8-1 TO 8-19

Uncoated and $Al_2O_3$-coated, 30 micron thick decorative layer samples had the very good appearance retention. $Al_2O_3$-coated white H34002 primer (30 micron) samples were marginally better than the 30-micron, uncoated white H34002 primer samples. $Al_2O_3$-coated 10-micron ceramic decal on 20 micron of white H34002 primer contained no scratches to the metal substrate.

Six-inch square samples were tested in the Walkers Test. Table 13 shows the sample descriptions and gives the raw data.

Three categories of wear layers were prepared. They were:

1. 30 micron-H34002 primer on 7-mil 302-steel.
2. $Al_2O_3$-coated, 30 micron-H34002 primer on 7-mil 302-steel.
3. $Al_2O_3$-coated, 10 micron-ceramic decal on 20 micron-H34002 primer on 7-mil 302-steel.

All samples tested had fewer scratches to the metal. As previously seen, the presence of the primer coat had eliminated spalling of the ceramic layer from the damage area. The damage of the $Al_2O_3$-coated decal samples was limited to the aluminum oxide layer and the decal only.

TABLE 8

| Description | Example No. | $Al_2O_3$ Thk. (Micron) | Walker Cycles | 60° Gloss Initial | 60° Gloss Final |
|---|---|---|---|---|---|
| 30 Micron H34002 Primer | 8-1 | — | 200 | 89.9 | 95.5 |
| | 8-2 | — | 400 | 90.8 | 93.8 |
| | 8-3 | — | 800 | 94.7 | 91.9 |
| | 8-4 | — | 1200 | 94.1 | 92.3 |
| | 8-5 | — | 1200 | 92.2 | 91.6 |
| | 8-6 | — | 1200 | 94.4 | 93.7 |
| | 8-7 | — | 1200 | 93.3 | 90.8 |
| $Al_2O_3$/30 Micron H34002 Primer | 8-8 | 5.1 | 200 | 103.6 | 105.7 |
| | 8-9 | 5.1 | 400 | 102.0 | 108.1 |
| | 8-10 | 5.1 | 800 | 100.1 | 103.3 |
| | 8-11 | 5.1 | 1200 | 99.1 | 102.4 |
| | 8-12 | 4.8 | 1200 | 103.3 | 106.9 |
| | 8-13 | 4.8 | 1200 | 102.6 | 105.6 |
| | 8-14 | 4.8 | 1200 | 101.2 | 105.5 |
| | 8-15 | 4.8 | 1200 | 101.5 | 102.7 |
| $Al_2O_3$/Ceramic Decal/20 Micron H34002 Primer | 8-16 | 4.6 | 200 | 87.6 | 96.2 |
| | 8-17 | 4.6 | 400 | 85.8 | 94.0 |
| | 8-18 | 4.6 | 800 | 90.9 | 92.7 |
| | 8-19 | 4.6 | 1200 | 89.6 | 94.5 |

EXAMPLES 9-1 TO 9-41

Structures were fabricated using Ion Assisted Physical Vapor Deposition (IAPVD) to deposit $Al_2O_3$ "ceramic" wear layers onto undecorated plastic substrates. These structures had the same average gloss retention profile as ceramic tile. Scratch and Walkers Tests demonstrated the synergistic relationship between the coating and substrate properties in these composites. Nanoindentation showed relationships between hardness, chemistry and the processes used to prepare the wear layers.

Flooring structures with 5–8 microns of $Al_2O_3$ supported by an undercoated, reinforced polyester substrate have gloss retention superior to currently marketed wear layer materials. However, individually visible scratches were apparent in these structures. Although these scratches did not affect gloss retention, the post-trafficking appearance of the coated structures would be improved if all scratches were prevented. The key to that prevention lies in obtaining a good match between the mechanical properties of the plastic substrate and the hard wear layer. In these examples, the aluminum oxide coating provided only limited improvement to the performance of any organic-containing substrate where adhesion failure (aluminum oxide removal) was a major factor.

Diamond stylus scratch testing and nonoindentation were the two main characterization tests to monitor mechanical property response for the title structures. The $Al_2O_3$ supported by polyester sheet molding compound (PSMC) show the highest stylus LSP (Load to Substrate Penetration), which is consistent with the superior gloss performance of such structures. Nonoindentation results show that $Al_2O_3$ is the hardest wear layer material tested in an actual flooring prototype in which a plastic support was employed. $Si_3N_4$ is suggested as an alternative material.

Ion Assisted Physical Vapor Deposition (IAPVD) was used to produce films for wear layers on plastic substrates. Metal or metal oxide vapor was evaporated by heating with an electron beam until it vaporized. When the vapor deposited on a substrate, simultaneous bombardment by an ion beam helped to form a dense, defect free film. Materials deposited onto plastic substrates include $Al_2O_3$ to and $Al_2O_3$-$SiO_x$. Test structures prepared by this technique are listed in Tables 9A, 9B and 9C.

TABLE 9A

IAPVD $Al_2O_3$ Wear layers on Non-decorated Plastic Substrates

| Sample No. | Wear Layer | Thickness (microns) | Support | Substrate | LDP[1] (grams) |
|---|---|---|---|---|---|
| 9-1 | $Al_2O_3$ | 1.5 | PES[2] | 2× tape/glass | 15 |
| 9-2 | $Al_2O_3$ | 4.9 | None | PSMC[3] | — |
| 9-3 | $Al_2O_3$ | 6.0 | None | PSMC | >35 |
| 9-4 | $Al_2O_3$ | — | PVC[4] | WT[5] | — |
| 9-5 | $Al_2O_3$ | 0.480 | PVC | WT | 10 |
| 9-6 | $Al_2O_3$ | 0.528 | PVC | WT | — |
| 9-7 | $Al_2O_3/SiO_x$ | 0.432 | PVC | WT | — |
| 9-8 | $Al_2O_3/SiO_x$ | 0.336 | PVC | WT | — |
| 9-9 | $Al_2O_3$ | 4.03 | None | GFRP[6] | ~35 |
| 9-10 | $Al_2O_3$ | 3.89 | None | FFP[7] | ~30 |
| 9-11 | $Al_2O_3$ | 4.03 | None | PSMC | >35, <50 |
| 9-12 | $Al_2O_3$ | 1.78 | None | PSMC | ~40 |
| 9-13 | $Al_2O_3$ | 1.78 | None | PEEK[8] | 30 |
| 9-14 | $Al_2O_3$ | 4.5 | None | Formica | 23 |
| 9-15 | $Al_2O_3$ | 2.0 | None | Formica | — |
| 9-16 | $Al_2O_3$ | 2.0 | None | Formica | — |

[1]Load to Substrate Penetration
[2]Polyethersulfone
[3]Polyester Sheet Molding Compound
[4]Polyvinylchloride
[5]Non-asbestos vinyl white tile base
[6]Glass Fiber Reinforced Polyester
[7]Fiber Filled Phenolic
[8]Polyetheretherketone

TABLE 9B

Comparative Examples
IAPVD $SiO_x$ Wear Layers on Nondecorated Plastic Substrates

| Sample No. | Thickness (microns) | Support | Substrate | LSP[1] (grams) |
|---|---|---|---|---|
| 9-17 | 2.3 | Kapton[2] | 2× tape/Glass | >15 |
| 9-18 | 1.2 | None | PMMA | 15 |
| 9-19 | 2.3 | None | PMMA | >15 |
| 9-20 | 1.1 | None | PMMA | >15 |
| 9-21 | 1.8 | None | PMMA | 10 |
| 9-22 | 1.2 | Kapton | 2× tape/Glass | 25 |
| 9-23 | 1.2 | PES[4] | 2× tape/Glass | 15 |
| 9-24 | 1.2 | PEEK[5] | 2× tape/Glass | 15 |
| 9-25 | 1.2 | Cronar[6] | 2× tape/Glass | 25 |
| 9-26 | 1.2 | None | Teflon[7] | <5 |
| 9-27 | 0.4 | PVC8 | WT9 | 5-10 |
| 9-28 | 1.4 | PVC | WT | 10 |
| 9-29 | 2.3 | PVC | WT | 15 |
| 9-30 | 3.8 | PVC | WT | 15 g-18 |
| 9-31 | 3.7 | PVC | WT | 15 g-18 |
| 9-32 | 2.8 | PVC | PSMC[10] | 23 |
| 9-33 | 5.3 | None | PSMC | ~28 |

[1]Load to Substrate Penetration
[2]DuPont Polyimide
[3]Polymethylmethacrylate
[4]Polyethersulfone
[5]Polyetheretherketone
[6]DuPont Photographic Polyester
[7]DuPont Polytetrafluroethylene
[8]Polyvinylchloride
[9]Non-asbestos Vinyl White Tile Base
[10]Polyester Sheet Molding Compound

TABLE 9C

Miscellaneous IAPVD Coatings on Plastic Substrates

| Sample No. | Thickness (microns) | Structure |
|---|---|---|
| 9-34 | 4.37 | $Al_2O_3$/PVC/CWT |
| 9-35 | 4.61 | $Al_2O_3$/PVC/CWT |
| 9-37 | <10 | $A10_x$/PVC/CWT |
| 9-38 | ~3 | $Al_2O_3$/PVC/CWT |

For flooring structures with $Al_2O_3$ thin hard coatings on selected plastic substrates: (1) an increase in wear layer hardness resulted in an increase in gloss retention and overall appearance retention; and (2) an increase in substrate hardness resulted in an increase in gloss retention and overall appearance retention.

Gloss retention for flooring structures with thin hard wear layers occurs because the hard coating resists penetration and subsequent removal. The hard coating serves as a barrier that protects the less scratch resistant plastic material. Therefore, the scratch test results reported here use an alternative term, "Load to Substrate Penetration" (LSP) rather than "Load to Incipient Damage" (LID). The LSP refers to the weight loading at which the diamond stylus penetrates the hard protective layer and enters the substrate below. For example, irreversible damage is caused by a stylus load of 15 grams for a $Al_2O_3$ coating on PSMC, and this low LID implies that poor gloss retention will be observed. However, the opposite is true. Gloss retention by thin, hard coatings depends upon both coating and substrate properties, and the LSP reflects that synergistic relationship better than does the LID.

Tables 9A, 9B and 9C contain the LSPs for most of the coatings that have been prepared.

Results from the scratch tests are clearly in agreement with the Walkers Test data regarding the superiority of $Al_2O_3$ as a wear layer. The LSP for $Al_2O_3$ on PSMC is higher than that of $SiO_x$.

The high LSPs for $Al_2O_3$ on PSMC predict, in agreement with Walkers Test data, that the PSMC should be the best support.

EXAMPLES 10-1 TO 10-4

This Walkers Test demonstrated that good gloss retention is obtained from a flooring structure consisting of a $Al_2O_3$ wear layer supported by a rigid plastic, like polyester sheet molding compound (PSMC). The performance rating of the $Al_2O_3$ coated metal substrates was complicated by the fact that water vapor contamination was present during some of the runs.

A structure consisting of 4-microns of $Al_2O_3$ on a thick plate of polyester sheet molding compound (PSMC) remained essentially free of small scratches, showing no hazing and retaining 86% of its measured gloss after 1200 walker cycles. It had, however, a number of individually visible scratches.

$Al_2O_3$ wear layers on (a) fabric filled phenolic (FFP), (b) black PSMC, and (c) glass fiber-reinforced polyester retained a lesser but still substantial portion of their original gloss. The uncoated controls, in contrast, were completely deglossed and covered with fine scratches that resulted in a final hazy appearance.

The samples were tested in the Walkers Test. Gloss measurements were obtained for the samples and listed in Table 10.

TABLE 10

Gloss values for 4 micron thick $Al_2O_3$ coated and uncoated rigid polymer substrates before and after Walkers Test trafficking

| Sample No. | Description | Initial | Final | Change | % Loss |
|---|---|---|---|---|---|
| 10-1 | $Al_2O_3$/White PSMC[1] | 46.5 | 39.7 | −6.8 | −14.6 |
| C10-1 | White PSMC | 57.5 | 2.5 | −55.0 | −95.7 |
| 10-2 | $Al_2O_3$/Black PSMC | 46.8 | 37.9 | −8.6 | −18.4 |
| C10-2 | Black PSMC | 64.2 | 2.6 | −61.6 | −96.0 |
| 10-3 | $Al_2O_3$/GFP[2] | 25.1 | 16.7 | −8.4 | −33.5 |
| C10-3 | GFP | 20.2 | 11.6 | −8.6 | −42.6 |

TABLE 10-continued

| Sample No. | Description | Initial | Final | Change | % Loss |
|---|---|---|---|---|---|
| | Gloss values for 4 micron thick $Al_2O_3$ coated and uncoated rigid polymer substrates before and after Walkers Test trafficking | | | | |
| 10-4 | $Al_2O_3$/FFP[3] | 69.1 | 45.6 | −23.5 | −34.0 |
| C10-4 | FFP | 52.1 | 9.7 | −42.4 | −81.4 |

[1]¼" Thick Polyester Sheet Molding Compound
[2]¼" Thick Glass Filled Polyester
[3]¼" Thick Fabric Filled Phenolic

EXAMPLE 11

$Al_2O_3$ and comparative $SiO_x$ wear layers on PSMC showed no significant gloss reduction after 1200 walker cycles, however there were some visible scratches. Test flooring structures using commercial wear layer materials all were completely deglossed and visibly scratched to a matte finish after the same test period. $Al_2O_3$ clearly outperformed $SiO_x$ for structures having a common substrate, and comparable wear layer thickness. The observations from this and other Walkers Tests clearly demonstrate that important aspects in the performance of hard inorganic wear layers on plastic substrates include wear layer thickness, wear layer hardness, and support rigidity.

Superior gloss retention and scratch resistance have been observed with new structures consisting of a reinforced plastic support and an inorganic wear layer. The support material was polyester sheet molding compound, and the wear layer consisted of a five to eight micron "thick" film of either $Al_2O_3$ or comparative $SiO_x$, prepared by IAPVD.

The comparative $SiO_x$ and $Al_2O_3$ coatings on PSMC were above the critical thickness required for wear resistance applications. Above that thickness limit, further increases in coating thickness have no apparent effect on either gloss retention or scratch resistance. Scratch tests suggest that the crossover point is in the one to three micron range.

Hardness of the coating material is a factor in determining gloss retention and scratch resistance. For example, despite being 2 microns thinner than its $SiO_x$ coated analog, the 5-6 micron "thick" $Al_2O_3$ coated PSMC samples started and finished the Walkers Test at higher gloss, and with fewer visible scratches. This is consistent with the previous observation that IAPVD $Al_2O_3$ is a harder material than IAPVD $SiO_x$.

Samples approximately six inches square were tested in the Walkers Test using the serpentine sample arrangement. Tables 11A and 11B list average gloss readings from the Walkers Test.

PSMC was obtained as 1241 ×12"×0.125" panels of L15402 Premi-Glass 1100-05, Cameo Colored, from Premix, Incorporated.

$Al_2O_3$ and comparative $SiO_x$ wear layers were evaporated from the e-beam gun without the use of crucible liners, and the chamber was cleaned and refoiled immediately prior to each deposition to avoid water vapor contamination.

TABLE 11

| Passes | Control PSMC Initial | Control PSMC Final | 8 micron Thick Comparative $SiO_x$ on PSMC Initial | 8 micron Thick Comparative $SiO_x$ on PSMC Final | 5-6 micron Thick $Al_2O_3$ on PSMC Initial | 5-6 micron Thick $Al_2O_3$ on PSMC Final |
|---|---|---|---|---|---|---|
| | Gloss Values for Polyester Sheet Molding Compound (PSMC) and Ceramic Wear Layers on PSMC after Walkers Test Trafficking | | | | | |
| 0 | 60.7 | — | 47.9 | — | 54.1 | — |
| 24 | 62.0 | 51.0 | 46.6 | 47.9 | 53.3 | 53.7 |
| 48 | 61.5 | 34.1 | 48.0 | 49.1 | 60.3 | 60.8 |
| 102 | 66.3 | 15.7 | 38.5 | 42.2 | 46.6 | 46.9 |
| 204 | 58.7 | 7.8 | 48.6 | 50.8 | 55.4 | 55.9 |
| 402 | 50.5 | 3.1 | 53.2 | 52.6 | 61.0 | 61.7 |
| 804 | 65.9 | 3.1 | 55.2 | 50.8 | 43.2 | 44.8 |
| 1200 | 60.0 | 2.8 | 53.1 | 49.0 | 58.7 | 59.4 |

EXAMPLES 12-1 TO 12-28

Samples approximately six inches square were tested in the Walkers Test. Initial and final gloss readings were made using a Mallinckrodt 60° Pocket Gloss Meter and B. A. Newman's template. Table 12A lists average gloss readings for the samples. Descriptions of the samples are given in Table 12B.

Alumina wear layers were deposited onto the samples by evaporating $Al_2O_3$ from the E-beam gun without the use of crucible liners. The procedure included a bakeout at 250° C. for 1 hour prior to each deposition to minimize water vapor contamination. For most runs, the substrate temperature was allowed to "float" starting at 30°-40° C. during the deposition runs. For depositions done without the ion gun, an $O_2$ atmosphere of $\sim 2.3\times10^{-4}$ Torr was maintained. Plasma cleaning, when employed, was for five minutes at a pressure of about $3\text{-}6\times10^{-4}$ Torr.

The substrates consisted of about 30 mils of Heraeus H34000 series White Overglaze Frits on a 7 mil stainless steel base. Ink fusion was done using either ovens or moving belt furnace.

Thickness measurements were done using the Amray Scanning Electron Microscope (SEM) or the Nikon Polarized Light Microscope (PLM).

TABLE 12A

| Example No. | 60° Gloss at Walker Count 0 | 200 | 800 | 1200 |
|---|---|---|---|---|
| 12-1 | 91.4 | — | — | 84.5 |
| 12-2 | 93.2 | — | — | 91.3 |
| 12-3 | 98.0 | — | — | 95.6 |
| 12-4 | 98.7 | — | — | 94.1 |
| 12-5 to -7 | 108.2[a] | 106.3 | 89.3 | 105.3 |
| 12-8 to -10 | 103.6[a] | 100.8 | 99.9 | 107.8 |
| 12-11 to -13 | 99.9[a] | 105.7 | 98.3 | 105.1 |
| 12-14 to -16 | 101.6[a] | 70.7 | 102.6 | 107.8 |
| 12-17 to -19 | 95.2[a] | 100.5 | 97.0 | 103.4 |
| 12-20 to -22 | 86.5[a] | 94.9 | 84.1 | 94.3 |
| 12-23 to -25 | 88.7[a] | 100.2 | 88.6 | 86.0 |
| 12-26 to -28 | 90.1[a] | 81.5 | 99.5 | 90.6 |

[a]average of three samples

TABLE 12B

| Example No. | WearLayer Thickness (microns) | Deposition Rate (A/S)[c] | Deposition Temperature (°C.) | Ion Cleaning Gas | $O_2$+ Ion Assist | $Al_2O_3$ Purity |
|---|---|---|---|---|---|---|
| 12-1 | 2.2 | 7.2 | 59-196 | Ar | Yes | 99.99% |
| 12-2 | 4.9 | 31 | 90-123 | Ar | Yes | 99.99% |
| 12-3 | 3.6 | 12 | 113-129 | Ar | Yes | 99.99% |
| 12-4 | 5.3 | 33 | 114-134 | Ar | Yes | 99.99% |

TABLE 12B-continued

| Example No. | WearLayer Thickness (microns) | Deposition Rate (A/S)[c] | Deposition Temperature (°C.) | Ion Cleaning Gas | $O_2$+ Ion Assist | $Al_2O_3$ Purity |
|---|---|---|---|---|---|---|
| 12-5 | 3.4 | 15 | 70–129 | Ar | Yes | 99.8% |
| 12-6 | 3.4 | 15 | 70–129 | Ar | Yes | 99.8% |
| 12-7 | 3.4 | 15 | 70–129 | Ar | Yes | 99.8% |
| 12-8 | 3.4 | 15 | 61–134 | Ar | Yes | 99.5% |
| 12-9 | 3.4 | 15 | 61–134 | Ar | Yes | 99.5% |
| 12-10 | 3.4 | 15 | 61–134 | Ar | Yes | 99.5% |
| 12-11 | 3.4 | 15 | 138–170 | Ar | Yes | 99.99% |
| 12-12 | 3.4 | 15 | 138–170 | Ar | Yes | 99.99% |
| 12-13 | 3.4 | 15 | 138–170 | Ar | Yes | 99.99% |
| 12-14 | 7.7 | 17 | 71–170 | Ar | Yes | 99.99% |
| 12-15 | 7.7 | 17 | 71–170 | Ar | Yes | 99.99% |
| 12-16 | 7.7 | 17 | 71–170 | Ar | Yes | 99.99% |
| 12-17 | 2.9 | 40 | 130–170 | Ar | Yes | 99.5% |
| 12-18 | 2.9 | 40 | 130–170 | Ar | Yes | 99.5% |
| 12-19 | 2.9 | 40 | 130–170 | Ar | Yes | 99.5% |
| 12-20 | 11.6 | 40 | 100–206 | Ar | Yes | 99.5% |
| 12-21 | 11.6 | 40 | 100–206 | Ar | Yes | 99.5% |
| 12-22 | 11.6 | 40 | 100–206 | Ar | Yes | 99.5% |
| 12-23 | 3.3 | 30 | 95–160 | Ar | No | 99.5% |
| 12-24 | 3.3 | 30 | 95–160 | Ar | No | 99.5% |
| 12-25 | 3.3 | 30 | 95–160 | Ar | No | 99.5% |
| 12-26 | 8.6 | 60 | 250 | Ar | Yes | 99.5% |
| 12-27 | 8.6 | 60 | 250 | Ar | Yes | 99.5% |
| 12-28 | 8.6 | 60 | 250 | Ar | Yes | 99.5% |

The results showed that gloss retention performance is relatively insensitive to $Al_2O_3$ deposition parameters. Thickness between 3u and 12u; deposition rates between 7 A/S and 60 A/S; and $Al_2O_3$ purity between 99.5 and 99.99% (for isostatically pressed powders or crystals) did not effect Walkers Test performance.

EXAMPLES 13-1 AND 13-2

Samples were tested in the Walkers Test. One sample each was pulled at 200 and 800 counts while two samples were trafficked to 1200 counts.

PBMC was decorated by sublimation imprinting. $Al_2O_3$ wear layers were evaporated by electron beam. No bake-out was used prior to evaporation.

Table 13A lists the data and gloss values for the samples tested. Stain resistance tests were done by applying each reagent for a period of four hours. The samples were cleaned with Micro and water followed by acetone. Delta E values were calculated from L, a, b readings on a Hunter Laboratory, Model D25 optical sensor. Table 13B lists the samples tested for stain resistance and their Delta E values.

TABLE 13A

| Example No. | Description | WearLayer Thickness (microns) | 60° Gloss at Walker Count 0 | 200 | 800 | 1200 |
|---|---|---|---|---|---|---|
| 13-1 | $Al_2O_3$/Sub. Imprint/PBMC | 4.7 ± 0.3 | 54.6 | 45.9 | 48.8 | 49.5 |
| 13-2 | $Al_2O_3$/Marble PBMC | 4.0 ± 0.3 | 61.1 | 56.7 | 56.5 | 51.7 |

TABLE 13B

| Example No. | Sanford Ink Delta-E | Iodine Delta-E | Shoe Polish Delta-E | Hair Dye Delta-E | Ball Point Ink Delta-E | Asphalt Delta E | Total Delta E |
|---|---|---|---|---|---|---|---|
| 13-1 | 9.34 | 2.17 | 3.91 | 2.39 | 8.77 | 1.87 | 28.53 |
| 13-2 | 6.75 | 1.35 | 2.94 | 1.30 | 17.39 | 2.64 | 32.37 |

No difference was observed in wear performance or adhesion of $Al_2O_3$ applied over decorated (sublimation imprint) and non-decorated PBMC. Overall wear performance was good. Wear performance of marbled PBMC with $Al_2O_3$ was similar to that of sublimation imprinted PBMC with $Al_2O_3$.

The samples maintained a fairly level gloss curve. The samples had very few fine scratches. The large scratches were not numerous. The scratches become readily visible when they penetrated the $Al_2O_3$ and destroyed the print. The white color of the scratches was apparently caused by stress whitening of the PBMC.

EXAMPLES 15-1 TO 15-15

Six-inch square samples were tested in the Walkers Test. Table 15 lists the sample descriptions and the respective gloss values.

Examples 15-1 to 15-12 were prepared with 7-mil, 302 stainless steel substrates. Examples 15-13 to 15-15 were prepared with 14-mil cold rolled steel supplied by Chicago Vitreous with their ceramic ground coat. The substrates were coated as follows:

Examples 15-1 to 15-4: 30 micron-H34002 primer and 10 micron-H34002 textured pattern with 20% matting agent H7003.

Examples 15-5 to 15-8: 30 micron-H34002 primer and 10 micron-H34002 textured pattern with 20% matting agent H7003 and a 5.95 micron thick clear, Heraeus H30011, protective ceramic glaze.

Examples 15-9 to 15-12: 30 micron-H34002 primer and 10 micron-H34002 textured pattern with 20% matting agent H7003 and a 2.40 micron thick aluminum oxide layer.

Examples 15-13 to 15-15: 56.6 micron of ground coat, 29.1 micron-H34002 primer as the wear layer.

The primer and matting agent were manufactured by Heraeus.

TABLE 15

| Example No. | Total Nominal Enamel Thickness (Micron) | Walker Cycles | 60° Gloss Initial | 60° Gloss Final | $Al_2O_3$ Wear Layer Thickness (Micron) |
|---|---|---|---|---|---|
| 15-1 | 40 | 200 | 52.8 | 67.5 | |
| 15-2 | 40 | 800 | 66.5 | 64.4 | |
| 15-3 | 40 | 1200 | 64.8 | 67.7 | |
| 15-4 | 40 | 1200 | 61.0 | 59.7 | |
| 15-5 | 40 | 200 | 57.4 | 65.6 | 5.95 |
| 15-6 | 40 | 800 | 55.2 | 53.3 | 5.95 |
| 15-7 | 40 | 1200 | 65.3 | 63.5 | 5.95 |
| 15-8 | 40 | 1200 | 61.7 | 64.6 | 5.95 |
| 15-9 | 40 | 200 | 71.9 | 75.1 | 2.40 |
| 15-10 | 40 | 800 | 72.5 | 71.0 | 2.40 |
| 15-11 | 40 | 1200 | 67.8 | 73.0 | 2.40 |
| 15-12 | 40 | 1200 | 66.3 | 66.6 | 2.40 |
| 15-13 | 86 | 200 | 89.8 | 95.5 | |
| 15-14 | | 800 | 90.6 | 96.0 | |
| 15-15 | | 1200 | 88.6 | 87.1 | |

As shown in Table 15, the gloss values of the three stainless-steel-substrate categories are essentially unchanged after a total traffic count of 1200. Appearance retention differences between the categories were noted however. The stainless-steel structure without a wear layer, exhibited more visually objectionable scratches than the glaze-coated and aluminum oxide-coated structures. These later two categories had hard protective wear layers which appear to afford increased scratch resistance.

Although the low-carbon-steel structure exhibited excellent gloss retention, scratch resistance was poor compared to the other structures. Most of the scratch damage was limited to the upper-most ceramic layer which was the Heraeus H34002 system. The type of damage present indicated a poor level of adhesion between the ground coat and the Heraeus ceramic.

Those of ordinary skill in the art can readily deposit hard inorganic films onto metallic substrates. However, little work has been done in the area of depositing hard inorganic materials on organic substrates. This is most likely due to the fact that those of ordinary skill in the art believe that the properties of the hard inorganic material would be degraded to a point at which the material would not be useful if it were deposited at a temperature low enough to allow deposition on the organic substrate without destroying the substrate. The present inventors have determined that good wear layer properties, particularly gloss retention, scratch resistance and stain resistance, are achievable even if the inorganic layer is deposited at a temperature of less than 175° C., preferably less than 150° C. and most preferably less than 100° C.

It is also generally accepted that as the thickness of a deposited film exceeds 0.5 microns, the stress builds to such a high level that spalling or flaking of the coating occurs. However, the present inventors have shown that 1 micron to 25 microns thick inorganic materials can be deposited on organic materials with sufficient adherence to perform as surface coverings.

Two problems have been associated with the vapor deposition of inorganic materials onto organic substrates. Films 1 micron to 25 microns thick deposited on organic substrates tend to discolor and crack. While the cracks and fractures degrade the ability of the deposited layer to prevent gas and liquid transmission, the overall performance of the protective layer, including appearance retention, exceeds the performance of thinner (less than one micron) low pressure environment deposited layers on both inorganic and organic substrates.

These problems have been minimized by keeping the organic substrate relatively cool. The substrates are radiation cooled by proximity to a cooled surface (e.g., water and glycol, or liquid nitrogen coolant) during the time the substrate is not in the deposition zone. The substrate typically spends 3 out of every 12 seconds in the deposition zone. The use of radiation cooling makes the fabrication of aluminum oxide/PVC composites possible.

Inorganic materials deposited on organic substrates by low pressure environment techniques tend to discolor more than when deposited on inorganic substrates. All of the polymeric substrates deposited on to date have discolored somewhat during the deposition process. The absolute amount of discoloration has been quite small—typically around 3 to 6 total Delta E. Some of the samples have been less than 3 total Delta E and some have been less than 1 total Delta E. For a discussion of Delta E see Richard S. Hunter, *The Measurement of Appearance,* a Wiley-Inerscience Publication, John Wiley & Sons, 1975.

Discoloration levels for aluminum oxide coatings on free-standing films, such as polyether sulfone (PES) and polyvinyl chloride (PVC), were done with a sheet of white bond paper behind the sample. Controls for the measurements were (as appropriate) the backside of the coated sample, the virgin surface of an uncoated sample, or a piece of uncoated film on top of white bond paper.

Although discoloration has not been affected by chamber temperatures between 50 and 200° C. during the aluminum oxide deposition on polyester sheet molding compound, it is believed that the discoloration is caused by trapping low molecular weight polymer fragments that are outgassing from the polymer support in the growing inorganic film. If the temperature were high enough to degrade the organic substrate, additional fragments would likely be trapped and the discoloration increased. There is strong indication that the discoloration is in the inorganic coating. Flakes removed from the organic substrate are discolored and the discoloration disappears from the substrate when the coating is dissolved.

EXAMPLES 16-1 TO 16-26

No correlation between chamber temperature and discoloration has been evident. Aluminum oxide was coated on a variety of PSMC formulations and surface treatments. The samples were prepared under a wide variety of deposition conditions. See Table 16A. The range of final chamber temperatures reported for the PSMC was from 50° C. to 155° C. Thus the substrates in these runs were exposed to differing thermal histories. All of the samples showed similar, relatively low Delta E values.

TABLE 16A

| Example No. | Temp Deg. C. | Thickness Microns | Ion Gun | Delta E |
|---|---|---|---|---|
| 16-1 | 50 | 4.10 | Yes | 9.09 |
| 16-2 | 126 | 4.80 | Yes | 5.16 |
| 16-3 | 135 | 4.00 | No | 5.24 |
| 16-4 | 135 | 4.00 | No | 5.50 |
| 16-5 | 145 | 4.70 | Yes | 2.50 |
| 16-6 | 153 | 4.32 | No | 3.60 |
| 16-7 | 154 | 5.80 | Yes | 5.60 |

TABLE 16A-continued

| Example No. | Temp Deg. C. | Thickness Microns | Ion Gun | Delta E |
|---|---|---|---|---|
| 16-8 | 155 | 4.50 | Yes | 4.14 |

The results are similar for other substrates. See Table 16B. The polyether sulfone (PES) sample had the highest level of discoloration which was probably caused by the inability to remove all adhesive from the sample prior to the Delta E measurement. The discoloration of the polybutylene terephthalate (PBTP) was similar to the PSMC.

TABLE 16B

| Example No. | Substrate | Temp. Deg. C. | Thickness Microns | Delta E |
|---|---|---|---|---|
| 16-9 | PVC/TILE | 50 | 4.1 | 8.13 |
| 16-10 | PVC/TILE | 54 | 0.95 | 5.4 |
| 16-11 | PVC/TILE | 54 | 0.95 | 4.3 |
| 16-12 | PVC/TILE | 54 | 1.42 | 3.54 |
| 16-13 | PVC/TILE | 54 | 1.42 | 3.19 |
| 16-14 | PBTP | 106 | 4.7 | 6.06 |
| 16-15 | PBTP | 117 | 4.5 | 2.14 |
| 16-16 | PBTP | 147 | 4.32 | 4.71 |
| 16-17 | PES | 104 | 4.7 | 4.81 |
| 16-18 | PES | 162 | 4.22 | 15.22 |
| 16-19 | PSMC | 50 | 4.1 | 9.09 |
| 16-20 | PSMC | 126 | 4.8 | 5.16 |
| 16-21 | PSMC | 135 | 4.1 | 5.24 |
| 16-22 | PES/PSMC | 135 | 4.1 | 5.5 |
| 16-23 | PSMC | 145 | 4.7 | 2.5 |
| 16-24 | PSMC | 153 | 4.32 | 3.6 |
| 16-25 | PSMC | 154 | 5.8 | 5.6 |
| 16-26 | PSMC | 155 | 4.5 | 4.14 |

EXAMPLES 17-1 TO 17-4

The level of discoloration appears to be dependent on the thickness of the inorganic layer deposited. Aluminum oxide was deposited sequentially on PSMC substrates with a 600mA/600V $O_2$ ion assist. The increased thickness also corresponds to increased exposure time.

TABLE 17

| Example No. | Deposition Time Minutes | Nominal Thickness Microns | Ave. Delta E |
|---|---|---|---|
| 17-1a | 110 | 10 | 12.82 |
| 17-1b | 110 | 10 | 9.67 |
| 17-2a | 56 | 5 | 8.57 |
| 17-2b | 56 | 5 | 6.69 |
| 17-3a | 11 | 1 | 2.14 |
| 17-3b | 11 | 1 | 3.79 |
| 17-4a | 1.1 | 0.1 | 0.53 |
| 17-4b | 1.1 | 0.1 | 1.77 |

EXAMPLES 18-1 TO 18-5

The level of discoloration appears to be more dependent on thickness than on the coater used to deposit the inorganic layer. Examples 18-1 to 18-5 were coated with aluminum oxide wear layers using three different batch coaters.

TABLE 18

| Example No. | Substrate | Coater | Thickness Microns | Delta E |
|---|---|---|---|---|
| 18-1 | Smooth White PBTP | (3) | 1.73 | 0.41 |
| 18-2 | Smooth White PBTP | (1) | 4.32 | 3.59 |
| 18-3 | Cameo PSMC | (3) | 1.73 | 1.06 |
| 18-4 | Cameo PSMC | (2) | 3.4 | 3.77 |

TABLE 18-continued

| Example No. | Substrate | Coater | Thickness Microns | Delta E |
|---|---|---|---|---|
| 18-5 | Cameo PSMC | (1) | 4.32 | 4.47 |

EXAMPLES 19-1 TO 19-20

The following examples show the effects of chamber temperature, ion source, and extraction grid on cracking. Example 19-1 was a typical deposition of aluminum oxide onto PSMC. Four microns of aluminum oxide was deposited onto PSMC, under typical conditions of about 20 Angstroms per second in oxygen at a pressure of $2.5\times10^{-4}$ Torr. The maximum temperature measured in the chamber was 153° C. The ion source was not used. The coating was cracked and slightly discolored (Delta E of 5.16).

As evident from Example 19-2, the reduction of average chamber temperature reduces the degree of cracking, but does not seem to affect the discoloration. About 2.9 microns of aluminum oxide was deposited onto PSMC which was radiation cooled by proximity to a cooled surface (water and glycol coolant at −23° C.) during the time the substrate was not in the deposition zone. The substrate typically spent 3 out of every 12 seconds in the deposition zone (at 5 rpm). The cracking of the aluminum oxide film was reduced, (the typical area of uncracked film was larger). The Delta E was 5.06.

In Example 19-3, the aluminum oxide coating on PSMC in a similar deposition system utilizing a Kaufman ion source yielded continuous coatings that were discolored. The aluminum oxide was deposited onto the PSMC substrate at an average rate of about 20 A/s and with a Kaufman type ion source operating at 500 eV per ion and a total beam current of about 40 mA. The thickness of the aluminum oxide was 3.2 microns. The coating was continuous and discolored. The Delta E was 3.77.

There is some evidence that increasing the ion energy flux from a Denton cold cathode ion source reduces cracking. This experiment compared a flat ion source extraction grid which concentrated the ion beam more than the convex extraction grid normally used for aluminum oxide coatings previously discussed. Four thicknesses of aluminum oxide were deposited sequentially onto four sets of various composition stationary substrates all during the same pumpdown of the vacuum system. For the flat grid, the thicknesses obtained were 0.1, 0.4, 3 and 6 microns (Examples 19-4 to 19-11). For the convex grid, the thicknesses obtained were estimated to be 0.1, 0.4 and 0.8 microns (Examples 19-12 to 19-17).

A primary observation for this experiment was the existence of a region on the PSMC substrate that was crack free with the concentrated ion beam even at a thickness of about 6 microns (Examples 19-10 and 19-11). There was no such region on the thickest samples prepared with the convex grid (Examples 19-16 and 19-17), even though the thickness was considerably less. A similar trend was observed when aluminum oxide was deposited onto a stationary 12"×12" PSMC sample (Example 19-18), with the flat extraction grid.

A combination of radiation cooling and changing the ion energy flux produced aluminum oxide coatings on PSMC that were continuous and coatings on PVC laminated to tile that were only slightly cracked. (Examples 19-19 and 19-20.) Both coatings were discolored. About four microns of aluminum oxide was deposited onto PSMC and PVC/tile substrates which were radiation cooled by proximity to a liquid nitrogen cooled surface. The ion source was equipped with a flat grid as in the prior paragraph. The aluminum oxide on the PSMC was not cracked. The aluminum oxide on the PVC/tile was cracked but significantly less than previous attempts.

TABLE 19

| Example No. | Nominal Thickness Micron | Chamber Temperature Deg. C. | Total Delta E | Degree of Cracking |
|---|---|---|---|---|
| 19-1 | 4.32 | 153 | 5.16 | normal |
| 19-2 | 2.9 | 101 | 5.06 | light |
| 19-3 | 2.6 | 290 | 3.77 | none |
| 19-4 | 0.1 | 57 | .53 | |
| 19-5 | 0.1 | 57 | 1.77 | |
| 19-6 | 0.4 | 90 | 2.14 | |
| 19-7 | 0.4 | 90 | 3.79 | |
| 19-8 | 3 | 98 | 8.57 | |
| 19-9 | 3 | 98 | 6.69 | |
| 19-10 | 6 | 95 | 12.82 | none to severe |
| 19-11 | 6 | 95 | 9.67 | |
| 19-12 | 0.1 | 34 | | none |
| 19-13 | 0.1 | 34 | | none |
| 19-14 | 0.4 | 67 | | none |
| 19-15 | 0.4 | 67 | | none |
| 19-16 | 0.8 | 95 | | <normal |
| 19-17 | 0.8 | 95 | | <normal |
| 19-18 | 6 | 85 | | |
| 19-19 | 4.1 | | | none |
| 19-20 | 4.1 | 51 | | light |

EXAMPLES 20-1 TO 20-4

Cracking can occur because of dimensional changes of the substrate (thermal expansion, stress relaxation or phase change), or a build up of stresses in the coating due to growth mechanisms (intrinsic film stress). The relative importance of each contributing factor depends on the structure and composition of the composite, the conditions governing the growth of the film and the thermal history of the evolving composite. These examples provide evidence that the conditions (i.e., eV/Atom ratio) governing the growth of the film, in the particular case of aluminum oxide on PSMC, are significant for the fabrication of continuous thick coatings.

The continuous aluminum oxide coating on PSMC was fabricated without attempting to limit the temperature of the polymer samples during the deposition. The temperature probe was located close to the primary source of heat, the electron beam evaporator, therefore the temperature in the region of the samples should be lower than what was observed at the thermocouple probe. The probe temperature was typically 300° C. Based on preliminary measurements with a second probe, the corresponding temperature in the region of the samples was estimated to be about 150° C. to 200° C. Only the probe temperature is reported in Table 20.

The crystal sensor for the deposition rate controller failed during the third crucible of each sample. The depositions were continued in "time power mode", a mode of the controller where the power is held constant at a level determined by averaging over a short period prior to crystal failure, for a time period calculated to give the desired thickness assuming the desired deposition rate.

Four sets of polymer samples were coated. The first set of samples were smooth plain white PSMC, unsaturated polyester resin filled with 70% feldspar and glass fibers. The second set included two types of textured PSMC and the last two sets were textured PBTP, polybutylene terephthalate filled with 55% mineral fillers. Table 20 contains deposition and evaluation information.

The deposition conditions were chosen from the conditions used on the decorated ceramic steel samples which yielded a compressive stress on Kapton coupons and with the mildest ion bombardment conditions. These conditions included a beam voltage of 500 volts and beam current of 40 milliamperes.

The combination of deposition rate and ion bombardment yielded 3 micron continuous films of aluminum oxide on the smooth PSMC. The texture of the other polymer substrates prevented evaluation of continuity by optical microscopy. Discoloration was noted after deposition on all of the samples. The initial gloss of the continuous aluminum oxide coatings on the smooth PSMC was significantly higher than on discontinuous coatings.

TABLE 20

| Example No. | Ion[a] Energy per Atom eV/a | Thickness[b] SR Microns | Thickness[b] SEM Microns | Coating[c] Mass grams | Coating[d] Density % Bulk % | Refractive[e] Index | Maximum Chamber Temp. deg. C. | Ar Ion Cleaning Volts | Ar Ion Cleaning mAmps | Total Deposition Time min | Ave[f] Rate A/s | Total Delta E |
|---|---|---|---|---|---|---|---|---|---|---|---|---|
| 20-1 | 43 | 3.4 | 3.2 | 0.0143 | 67.4 | 1.70 | 290 | 1200 | 61 | 149 | 3.6 | 3.77 |
| 20-2 | 39 | 3.3 | 3.1 | 0.0155 | 75.4 | 1.70 | 289 | 1200 | 62 | 147 | 3.5 | |
| 20-3 | 41 | 3.2 | 3.1 | 0.0150 | 73.0 | 1.65 | 256 | 1200 | 64 | 148 | 3.5 | 9.74 |
| 29-4 | 39 | 3.0 | 3.2 | 0.0153 | 72.1 | 1.50 | 251 | 1200 | 64 | 146 | 3.7 | 12.77 |

[a]based on listed density and average deposition rate.
[b]SR thickness is based on a 1.60 refractive index, SEM thickness is corrected for small differences between the width of the coating and the width of the measurement bar in SEM photos.
[c]mass change of coated 1 × 3 inch ferrosteel coupon (16.7 sqcm).
[d]based on SEM thickness, mass, area coated, and 3.97 g/cc bulk density of aluminum oxide, (mass × 100)/(thickness × area × bulk-density).
[e]based on optical (SR) and physical (SEM) thickness measurements, (listed SR thickness/1.6)/(SEM thickness).
[f]SEM thickness divided by deposition time.

We claim:

1. A surface covering comprising a polymeric support layer and a substantially homogeneous wear layer deposited directly on said polymeric support layer by a reduced pressure environment technique, said wear layer being from 1 to 25 microns in thickness, said wear layer comprising a hard inorganic material selected from the group consisting of aluminum oxide, aluminum nitride, silicon nitride, aluminum oxynitride and silicon oxynitride.

2. The surface covering of claim 1, wherein the wear layer is 2 microns to 25 microns in thickness.

3. The surface covering of claim 2, wherein the wear layer is 3 microns to 15 microns in thickness.

4. The surface covering of claim 1, wherein the hard inorganic material is aluminum oxide.

5. The surface covering of claim 1, wherein the polymeric layer comprises a thermoset selected from the group consisting of thermoset polyester thermoset polyurethane, thermoset polyacrylate, polyether and epoxy.

6. The surface covering of claim 1, wherein the polymeric layer comprises a thermoplastic selected from the group consisting of thermoplastic polyester thermoplastic polyurethane, thermoplastic polyacrylate, polycarbonate and polyvinyl.

7. The surface covering of claim 1, wherein the wear layer is deposited on the support at a temperature of less than 175° C.

8. The surface covering of claim 7, wherein the wear layer is deposited on the support at a temperature of less than 150° C.

9. The surface covering of claim 8, wherein the wear layer is deposited on the support at a temperature of less than 100° C.

10. The surface covering of claim 1, wherein the wear layer is free of added boron oxide.

11. The surface covering of claim 10, wherein the wear layer is free of added silicon oxide.

12. A surface covering comprising a support and a wear layer deposited on said support by a reduced pressure environment technique, said wear layer being from 1 micron to 25 microns in thickness, said wear layer consisting essentially of a hard inorganic material selected from the group consisting of aluminum oxide, aluminum nitride, silicon nitride, aluminum oxynitride, silicon oxynitride and mixtures thereof, and said wear layer being substantially transparent and substantially colorless.

13. The surface covering of claim 1 wherein the surface covering is a floor covering.

14. The surface covering of claim 1 wherein the polymeric support layer is a plastic web.

15. The surface covering of claim 1 wherein the polymeric support layer has a thickness of from 0.0005 inches to 0.25 inches.

16. The surface covering of claim 12 wherein the surface covering is a floor covering.

17. The surface covering of claim 12 wherein the wear layer consists essentially of aluminum oxide.

* * * * *